US007319462B2

(12) United States Patent
Ogawa et al.

(10) Patent No.: US 7,319,462 B2
(45) Date of Patent: Jan. 15, 2008

(54) DISPLAY APPARATUS, DRIVING METHOD, AND PROJECTION APPARATUS

(75) Inventors: Yasuyuki Ogawa, Yamatokoriyama (JP); Tamotsu Sakai, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 645 days.

(21) Appl. No.: 10/361,507

(22) Filed: Feb. 11, 2003

(65) Prior Publication Data

US 2003/0184534 A1 Oct. 2, 2003

(30) Foreign Application Priority Data

Mar. 26, 2002 (JP) ..... 2002-087058
Dec. 18, 2002 (JP) ..... 2002-367310

(51) Int. Cl.
*G09G 5/00* (2006.01)

(52) U.S. Cl. ..... 345/204; 345/87; 345/90; 345/98; 345/100; 345/89

(58) Field of Classification Search ..... 345/87–89, 345/90, 92, 98, 100, 204–206, 77, 78, 690
See application file for complete search history.

(56) References Cited

U.S. PATENT DOCUMENTS 4,335,380 A * 6/1982 Wright ..... 345/13
5,287,025 A * 2/1994 Nishimichi ..... 327/156
5,619,225 A * 4/1997 Hashimoto ..... 345/98
6,232,947 B1 * 5/2001 Miyawaki et al. ..... 345/99
6,337,677 B1 * 1/2002 Higashi ..... 345/100
6,373,458 B1 * 4/2002 Yamakura et al. ..... 345/98
6,618,043 B2 * 9/2003 Washio et al. ..... 345/204
6,693,617 B2 * 2/2004 Sasaki et al. ..... 345/98
6,697,040 B2 * 2/2004 Imajo et al. ..... 345/98
6,784,880 B2 * 8/2004 Fujita et al. ..... 345/213
6,864,874 B1 * 3/2005 Ozawa ..... 345/99

(Continued)

FOREIGN PATENT DOCUMENTS

EP 0554051 * 1/1993

(Continued)

OTHER PUBLICATIONS

Korean Office Action mailed Dec. 21, 2004 (w/English translation thereof).

*Primary Examiner*—Richard Hjerpe
*Assistant Examiner*—Jennifer T. Nguyen
(74) *Attorney, Agent, or Firm*—Nixon & Vanderhye, P.C.

(57) ABSTRACT

In a display apparatus in accordance with the present invention, (i) a sampling circuit for sampling video signals supplied via a plurality of video lines and (ii) connecting lines for connecting the video lines with respective analog switch groups in the sampling circuit, the connecting lines being provided so as to intersect with the video lines, are integrally formed on a single substrate, and a delay adjustment section is further provided for delaying the video signals which pass through the video lines, in order to compensate the difference of the delay between the video signals passing through the connecting lines. With this arrangement, the difference of the delay between the pathways of the video signals from the video lines to the sampling circuit is compensated and this makes it possible to eliminate the non-uniformity of luminance looking like lines in the display apparatus so as to improve the display quality of the same.

26 Claims, 10 Drawing Sheets

U.S. PATENT DOCUMENTS 6,876,352 B1 * 4/2005 Sato et al. ..... 345/100

FOREIGN PATENT DOCUMENTS

JP 7-175038 A 7/1995
JP 7-319428 A 12/1995
JP 08-262994 10/1996
JP 9-325370 A 12/1997

* cited by examiner

DISPLAY APPARATUS, DRIVING METHOD, AND PROJECTION APPARATUS

FIELD OF THE INVENTION

The present invention relates to a display apparatus in which pixel display sections, video signal lines for supplying video signals to the pixel display sections, and at least a sampling circuit among drive circuits for driving the pixel display sections are integrated so as to be formed on a single substrate, a driving method of the display apparatus, and a projection apparatus including the display apparatus.

BACKGROUND OF THE INVENTION

With better downsizing potentiality and smaller power consumption than CRTs (Cathode Ray Tubes), liquid crystal display apparatuses are widely used not only for mobile electronic devices but also for stationary electronic devices such as personal computers. In particular, active matrix liquid crystal display apparatuses, in which a switching element is provided in each of pixel display sections in a display panel, excel in good contrast by nature and potentiality to increase the speed of response, and hence the active matrix liquid crystal display apparatuses have been widely used in recent years.

As the switching elements of those active matrix liquid crystal display apparatuses, along with non-linear resistive elements and semiconductor elements, thin film transistors (hereinafter, will be referred to as TFT) formed on a transparent insulating substrate have widely been adopted, since they can realize transmissive displaying and can be easily enlarged.

Among the different types of TFTs, TFTs in which a semiconductor layer of a channel part is made of polycrystalline silicon (p-Si) consume lower electric power and can speedily respond, compared to conventional TFTs using amorphous silicon (a-Si). Since the TFTs using p-Si realizes speedy response, a liquid crystal drive circuit can be fabricated by providing the TFTs using p-Si on the periphery of a liquid crystal display apparatus. In this way, it is possible to utilize the TFTs using p-Si for a monolithic process by which a display section and a drive circuit section are integrally formed on a single substrate. Liquid crystal display apparatuses in which this integral formation is realized are called driver-monolithic liquid crystal display apparatuses.

The following description will discuss an arrangement of a driver-monolithic liquid crystal display apparatus including driver circuits, with reference to FIGS. 7 and 8.

FIG. 7 is a schematic diagram illustrating a conventional display apparatus. The display apparatus of FIG. 7 is provided with: a display section 100 (including a plurality of pixel TFTs and a plurality of pixel display sections which are both provided in a matrix manner, a plurality of signal lines, plurality of scanning lines both connected to the pixel TFTs and the pixel display sections, the signal lines intersecting with the scanning lines in an orthogonal manner); a signal line drive circuit 200; a scanning line drive circuit 300 for supplying desired video signals to the desired pixel display sections via the signal lines and the scanning lines connected to the pixel TFTs; and, video lines 400 for supplying the video signals.

FIG. 8 is a schematic diagram illustrating the arrangement of the display section 100 in detail. The display section 100 of FIG. 8 is provided with: a signal line group 120 composed of a plurality of signal lines; a scanning line group 110 composed of a plurality of scanning lines; and pixel TFTs 130. The pixel TFTs 130 correspond to the respective intersections of the signal lines of the group 120 and the scanning lines of the group 110, and each of the pixel TFTs 130 is arranged in such a manner that a gate terminal is connected to a scanning line, either one of a source terminal and a drain terminal is connected to a signal line, and the other is connected to a pixel display section. For instance, in the pixel TFT 130 in FIG. 8, a gate terminal 131 is connected to a scanning line 111, a source terminal 132 is connected to a signal line 121, and a drain terminal 133 is connected to a pixel display section 140.

In FIG. 8, an electric potential is supplied via the scanning line 111. The pixel TFT 130 functions as a switching element for electrically connecting a pixel electrode included in the pixel display section to the signal line 121.

Moreover, the signal line drive circuit 200 supplies the video signals, which have been supplied via the video lines 400, to the desired signal lines.

Further, the scanning line drive circuit 300 applies a voltage, which is either for turning the pixel TFTs ON (in this case, the voltage will be referred to as scanning line select voltage) or for turning the pixel TFTs OFF (in this case, the voltage will be referred to a scanning line non-select voltage), to the desired scanning lines in each horizontal period.

In this arrangement, the optical transmittance of a liquid crystal layer between a pixel electrode and an opposing electrode of the pixel display section is controlled by applying a voltage which is equivalent to a desired video signal to the layer between the pixel electrode and the opposing electrode, so that desired pixel display is carried out.

A liquid crystal display apparatus as described above is just one example of apparatus which uses a pixel TFT. Display apparatuses such as active matrix EL (Electro Luminescence) display apparatuses also include pixel TFTs, and hence also in these display apparatuses, video signals are supplied to pixel display sections via respective pixel TFTs. For this reason, the foregoing description is applicable to driver-monolithic display apparatuses in general.

FIG. 10 shows an arrangement of a projection apparatus including a liquid crystal display apparatus. The projection apparatus in FIG. 10 includes liquid crystal panels 601, 602, and 603 corresponding to respective colors of R, G, and B, so as to be a so-called three-panel type liquid crystal projection apparatus. The projection apparatus is arranged in such a manner that after separating a light beam emitted from a lamp 614 such as a UHP lamp (high-pressure mercury pump) into R, G, and B using a dichroic mirror 605, the beams of R, G, and B enter the respective liquid crystal panels 601-603, and then the beams of R, G, and B are re-united by a cross prism 606 so as to be projected on a screen using a projection lens 607. To put it another way, each of the liquid crystal panels 601-603, which functions as a filter allowing a monochromatic light beam which is R, G, or B to pass through, facilitates tonal displaying including halftones by controlling the optical transmittance, so as to realize full-color displaying by synthesizing tones obtained in each colors of R, G, and B.

Display apparatuses with higher resolution have been demanded in recent years, and since the time allocated for one pixel on the occasion of carrying out refreshing with a constant frequency has become shorter as the number of pixels used for displaying increases, it has been required to speedily sample video signals. For instance, as the dot clock frequency is 65 MHz in the case of XGA (1024×768) resolution and 74.34 MHz in the case of DTV (1280×720)

resolution, simple mathematics demonstrate that the time allocated for one pixel is no more than 10-15 nsec. Moreover, when double-speed driving is carried out in order to restrain the flicker of displaying, the time allocated for the sampling is halved.

A method (so-called a method of multipoint simultaneous sampling) which has conventionally been used for responding to this requirement of high-speed sampling is arranged such that a sufficient sampling period is secured by serial-parallel converting of the video signals for some pixels, using an IC provided outside of the substrate. Using this method, it is possible to set the sampling period to be, for instance, 6 times longer on the occasion of 6-point simultaneous sampling and 12 times longer on the occasion of 12-point simultaneous sampling, compared to conventional sampling.

FIG. 9 shows an internal arrangement of a signal line drive circuit which uses a multipoint simultaneous sampling method as described below.

The signal line drive circuit in FIG. 9 is provided with a shift register circuit 210 and a sampling circuit 230. Sampling pulse signals which are progressively outputted from the shift register circuit 210 are supplied to the gates of an analog switch group 240 which is provided in the sampling circuit 230 and composed of a plurality of analog switches for sampling. In accordance with the signals supplied to the gates, the analog switch group 240 connects one of lines 401-403 which constitute a video line group 400 to a desired signal line. That is to say, the analog switch group 240 is turned ON when the sampling pulse signals are supplied, so as to sample the video signals. These video signals are supplied to signal lines via the analog switch group 240, and eventually reaches the desired pixel.

The signal line drive circuit in FIG. 9 shows an example of 3-point simultaneous sampling by which a sampling pulse signal outputted from the shift register circuit 210 is branched off and then inputted simultaneously to, for instance, analog switches 241-243 for sampling. In short, in the foregoing example, the analog switches 241-243 are simultaneously operated by the sampling pulse signals.

After being inputted via the video lines 401-403, the video signals are supplied to the analog switches 241-243 via connecting lines 251-253 provided so as to intersect with the video lines 401-403. In this arrangement, it is ideal that the total resistances (the amounts of the delay of the video signals) of respective three pathways for supplying the video signals from input terminals to the analog switches via three video lines are identical with each other. This is because the non-uniformity of luminance looking like lines is identified on the occasion of displaying, unless the video signals, which are supplied via three pathways and to be simultaneously sampled, are equally transmitted.

For instance, liquid crystal display apparatuses receive a signal with oscillation around 4-5V as a video signal, and when 128 tones are realized as analog levels, the deviation of tones is caused by only a dozen mV of voltage fluctuation. Thus, to improve the display quality, it is essential to equalize the electrical characteristics of the pathways for transmitting video signals and to supply the signals uniformly. In other words, it is necessary to eliminate the difference (of the delay of) the video signals which is caused in connecting lines, to improve the display quality.

There are known conventional arts for eliminating this difference of the delay of video signals between connecting lines, such as a patent document 1 (Japanese Laid-Open Patent Application No. 7-175038/1995 (Tokukaihei 7-175038; published on Jul. 14, 1995)), a patent document 2 (Japanese Laid-Open Patent Application No. 7-319428/1995 (Tokukaihei 7-319428; published on Dec. 8, 1995), and a patent document 3 (Japanese Laid-Open Patent Application No. 9-325370/1997 (Tokukaihei 9-325370; published on Dec. 16, 1997).

According to these patent documents, the following measures are taken to equalize the electrical characteristics of the pathways for transmitting video signals and to compensate the difference of the delay of video signals between connecting lines.

That is to say, according to the patent document 1, the location of a contact hole for connecting analog switches to connecting lines branched from video lines is moved by the distance between the video lines, in order to equalize the resistances of respective connecting lines.

According to the patent document 2, connecting lines branched from video lines are formed by respective p-Si films to each of which a different amount of N-type impurity ion is injected, in order to equalize the resistances of the respective connecting lines.

Moreover, according to the patent document 3, the widths or the lengths of connecting lines branched from video lines are adjusted in order to substantially equalize the resistances of the respective connecting lines.

Incidentally, the downsizing and the improvement of resolution of display apparatuses such as liquid crystal display apparatuses have recently been required.

However, the techniques disclosed by the foregoing patent documents (hereinafter, these techniques will be referred to as conventional techniques) focus on the adjustment of the resistances of connecting lines branched from video lines or the resistances of the contact sections between the connecting lines and analog switches for sampling.

Thus, the conventional techniques have such problems that the design flexibility is significantly limited and the resistances of the connecting lines or the resistances of the contact sections between the connecting lines and the analog switches could be increased.

The following is the detailed description of these problems.

When a plurality of connecting lines are provided so as to intersect with a plurality of video lines, in order to avoid a connecting line to be short-circuited with video lines other than the video line which should be connected to the connecting line, it is necessary that the video lines are formed on a layer different from a layer on which the connecting lines are formed, and the video lines are selectively connected to the connecting lines.

Being required to have low resistance, the video lines are made of metals with low resistance such as aluminum. In the meantime, the connecting lines from the video lines to the analog switches are often made of materials with high resistance. For instance, to simplify the fabricating process, it is effective to adopt a material identical with the material of a gate electrode, such as a polycrystalline silicon thin film, to the connecting lines.

However, since the sheet resistance of the polycrystalline silicon thin film is a dozen times higher than the resistance of the metal with low resistance which is used for the video lines and also the resistance of a connecting line connecting the video line and the sampling circuit is significantly varied in accordance with the distance from the video line to the sampling circuit, it is necessary to tailor the layout of each connecting line to equalize the resistances of all connecting lines.

In particular, in the case of high-resolution display apparatuses with not more than 20 μm pixel spacing, since the foregoing conventional arts are all arranged so as to increase the resistances of signal pathways to be equal to the signal pathway with the highest resistance, the design flexibility is restrained and this could cause the increase of the resistances in totality, which is a fatal drawback to the demand of high-speed sampling.

As a result, the display quality of the high-resolution display apparatuses with not more than 20 μm line spacing is deteriorated because, since each of the pathways for supplying video signals has different resistance, the video signals are supplied at different speeds and hence the non-uniformity of luminance (non-uniformity of displaying), which looks like lines, is identified on the occasion of displaying.

Moreover, in order to downsize the projection apparatus in FIG. 10, it is required not only to downsize the liquid crystal display apparatus but also to improve the resolution thereof. However, since conventional liquid crystal display apparatuses are not suitable for downsizing and the improvement of resolution, there has been a limit for the downsizing and the improvement of resolution of the projection apparatus, when a conventional liquid crystal display apparatus is adopted.

SUMMARY OF THE INVENTION

The objective of the present invention is to provide (i) a display apparatus in which the non-uniformity of luminance looking like lines is eliminated so that the display quality is improved especially when the improvement of resolution is required, by adjusting the amounts of the delay of video signals to be supplied to video lines, in order to compensate the difference of the delay between the video signals of the respective pathways from the video lines to a sampling circuit, (ii) a driving method of the display apparatus, and (iii) a projection apparatus adopting the display apparatus.

To achieve the foregoing objective, the display apparatus in accordance with the present invention is characterized by comprising: a plurality of pixel display sections provided in a matrix manner; a plurality of video lines for supplying video signals; a plurality of signal lines which are connected to the respective plurality of pixel display sections, so as to supply the video signals to the plurality of pixel display sections; a plurality of sampling means for sampling the video signals supplied via the plurality of video lines and supplying the video signals to the plurality of signal lines; a plurality of connecting lines for connecting the plurality of video lines to the plurality of sampling means, the plurality of connecting lines being provided so as to intersect with the plurality of video lines; and delay means for delaying the video signals which pass through the plurality of video lines, in order to compensate difference of delay of the plurality of video signals between the plurality of connecting lines, at least the plurality of pixel display sections, the plurality of video lines, the plurality of signal lines, the plurality of sampling means, and the plurality of connecting lines being integrally formed on a single substrate.

According to this arrangement, the delay means for delaying the video signals passing through the video lines is provided in order to compensate the difference of the delay between the video signals passing through the connecting lines, and hence the connecting lines receive the video signals which have been delayed in advance. In other words, the difference of the resistances between the pathways from the respective video lines to the sampling means via the connecting lines is compensated by delaying the video signals passing through the video lines.

With this arrangement, the video signals passing through the video lines are delayed by the delay means in order to compensate the delay caused by the difference of the resistances between the connecting lines, the difference of the resistances being predominantly caused in accordance with the difference of the lengths of the connecting lines, so that it is possible to almost simultaneously input the video signals from the connecting lines to the sampling means.

Thus, since the delay of the video signals occurring on the pathways from the video lines to the sampling means is compensated, the non-uniformity of luminance looking like lines, the non-uniformity being generated due to the difference of the delay between the video signals on the occasion of inputting to the sampling means, is eliminated so that it is possible to improve the display quality.

Moreover, with this arrangement, the difference of the delay between the video signals passing through the connecting lines, i.e. the difference of the resistances caused by the difference of the lengths of the connecting lines is compensated by adjusting the amounts of the delay of the video signals passing through the video lines, without changing the widths and the lengths of the connecting lines. For this reason, it is possible to obtain the design flexibility of the connecting lines and the sampling means.

In this manner, since it is unnecessary to arrange the connecting lines and the sampling means in an over-elaborated manner, it is possible to optimally design the pixel display sections especially in the case of display apparatuses requiring high-speed sampling, such as high-resolution display apparatuses with not more than 20 μm pixel spacing. On this account, it is possible to eliminate the non-uniformity of luminance looking like lines so as to obtain good display quality, while the high-speed sampling being realized.

The driving method of the display apparatus in accordance with the present invention, including: a plurality of pixel display sections; a plurality of video lines for supplying video signals; a plurality of signal lines which are connected to the respective plurality of pixel display sections, so as to supply the video signals to the plurality of pixel display sections; a plurality of sampling means for sampling the video signals supplied via the plurality of video lines and supplying the video signals to the plurality of signal lines; and a plurality of connecting lines for connecting the plurality of video lines to the plurality of sampling means, the plurality of connecting lines being provided so as to intersect with the plurality of video lines, the plurality of pixel display sections, the plurality of video lines, the plurality of pixel display sections, the plurality of video lines, the plurality of signal lines, the plurality of sampling means, and the plurality of connecting lines being integrally formed on a single substrate, the method of driving the display apparatus is characterized by comprising the step of: delaying the video signals and then inputting the video signals from the plurality of video lines to the plurality of connecting lines, in order to compensate difference of delay of the video signals, the difference of delay occurring between the plurality of connecting lines.

In this arrangement, it is unnecessary to provide the delay means, which is for delaying the video signals passing through the video lines, inside the drive circuits of the display apparatus. To put it another way, the delay means may be provided inside the drive circuits of the display apparatus, or the delay means may be provided outside of the same.

On this account, with a simpler arrangement, it is possible to realize a display apparatus in which the difference of the delay between the video signals passing through the connecting lines is compensated so that the display quality can be improved.

The present invention discussed as above can be adopted to any kinds of display apparatuses as long as pixel display sections and a sampling circuit which is one of drive circuits are integrally formed on a single substrate, and hence, for instance, the present invention is suitably adopted to liquid crystal display apparatuses.

Moreover, when a liquid crystal display apparatus is used for magnified projection as in the case of projection apparatuses, it is necessary to use a liquid crystal display apparatus with high-resolution and high display quality in order to realize high-resolution and high-quality projection display.

For this reason, the present invention is suitably adopted to liquid crystal display apparatuses requiring high resolution and good display quality, and hence adopting the present invention enables to realize a projection apparatus with high resolution and high quality display.

For a fuller understanding of the nature and advantages of the invention, reference should be made to the ensuing detailed description taken in conjunction with the accompanying drawings.

DESCRIPTION OF THE EMBODIMENTS

The following descriptions will discuss example embodiments with reference to FIGS. 1-10.

Embodiment 1

An embodiment of the present invention is described as below. In the present embodiment and other embodiments discussed later, an active matrix liquid crystal apparatus is regarded as a display apparatus.

Figure 1:
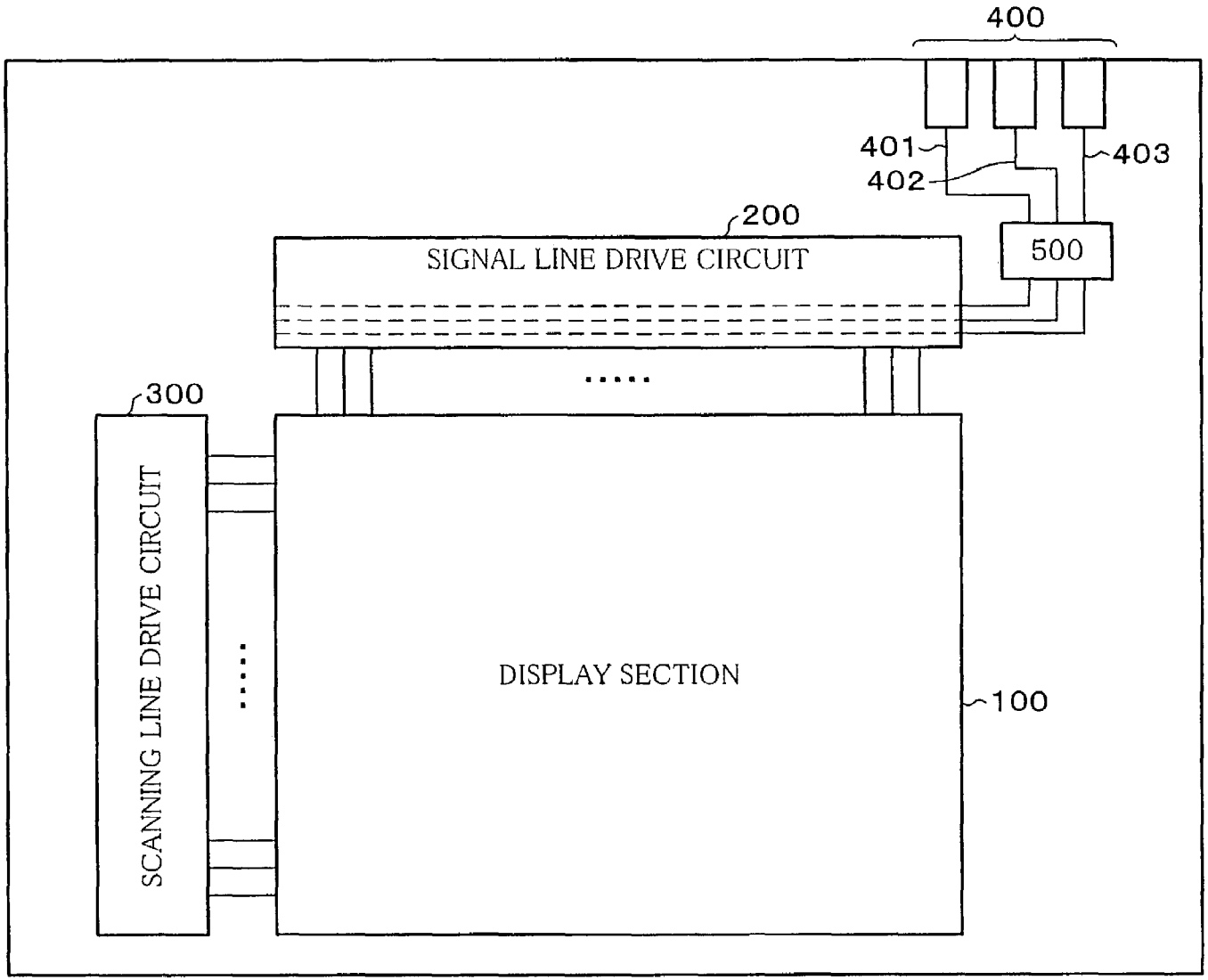
FIG. 1 is a schematic diagram, illustrating a liquid crystal display apparatus in accordance with an embodiment of the present invention.

An active matrix liquid crystal display apparatus in accordance with the present embodiment is, as FIG. 1 illustrates, provided with: a display section 100 (including a plurality of pixel display sections provided in a matrix manner, pixel TFTs for driving the pixel display sections, a plurality of signal lines; and a plurality of scanning lines which are both connected to the pixel display sections and the pixel TFTs and intersect with each other in an orthogonal manner); a signal line drive circuit 200 and a scanning line drive circuit 300 which are drive circuits for supplying desired video signals to the desired pixel display sections via the signal lines and the scanning lines both connected to the pixel TFTs; and a video signal input section 400 including video lines 401-403 for transmitting the video signals. The active matrix liquid crystal display apparatus is a so-called driver-monolithic liquid crystal display apparatus in which the display section 100, the signal line drive circuit 200, the scanning line drive circuit 300, and the video signal input section 400 are integrally formed on a single substrate.

As shown in FIG. 1, the liquid crystal display apparatus is further provided with a delay adjustment section 500 as delay adjustment means for adjusting the amounts of the delay of video signals which are transmitted via the video lines in the video signal input section 400. This delay adjustment section 500 will be specifically described later.

Figure 2:
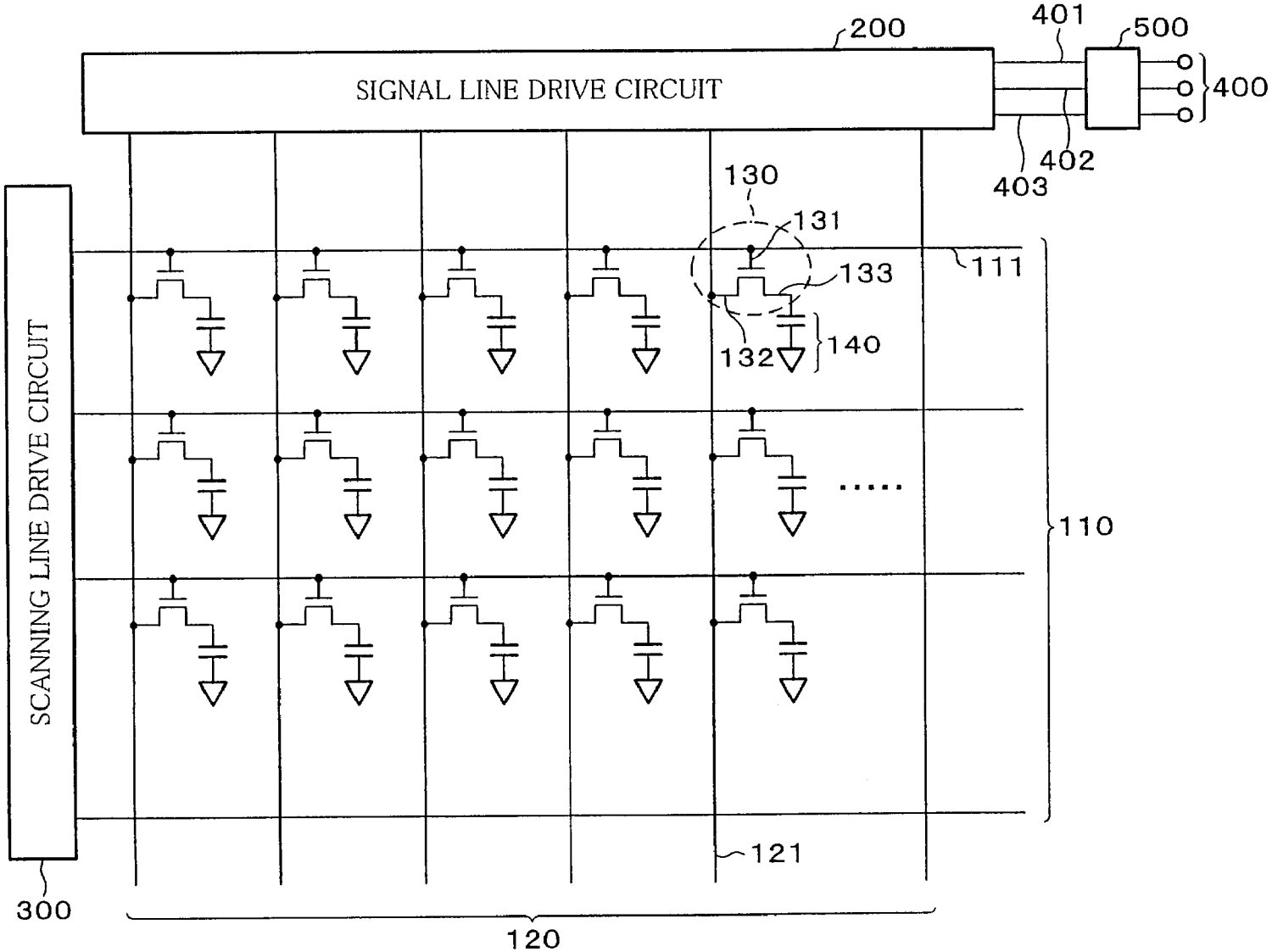
FIG. 2 is a view, schematically illustrating an arrangement of drive circuits and a display section in the liquid crystal display apparatus of FIG. 1.

As FIG. 2 illustrates, the display section 100 includes a signal line group 120 composed of a plurality of signal lines 121, a scanning line group 110 composed of a plurality of scanning lines 111, and a plurality of pixel TFTs 130.

The pixel TFTs 130 correspond to the respective intersections of the signal lines 121 and the scanning lines 111, and each of the pixel TFTs 130 is arranged in such a manner that a gate terminal 131 is connected to the scanning line 111, a source terminal 132 is connected to the signal line 121, and a drain terminal 133 is connected to the pixel display section 140. The pixel TFT 130 is an analog switch composed of a single-channel (NMOS or PMOS) TFT, and functions as a switching element for electrically connecting a pixel electrode in the pixel display section 140 to the signal line 121, using an electric potential supplied via the scanning line 111.

The signal line drive circuit 200 supplies the video signals supplied via the video lines of the video signal input section 400 to the desired signal lines 121. In the meantime, the scanning line drive circuit 300 applies a voltage for turning the pixel TFTs 130 ON (hereinafter, the voltage will be referred to as scanning line select voltage) or a voltage for turning the pixel TFTs 130 OFF (hereinafter, the voltage will be referred to as scanning line non-select voltage) to the desired scanning lines 111 in each horizontal period.

According to this arrangement, in the pixel display section 140, the optical transmittance of a liquid crystal layer between each of the pixel electrodes and each of opposing electrodes is controlled by applying a voltage, which is equivalent to a desired video signal, to the layer between the pixel electrode and the opposing electrode, so that desired pixel displaying is carried out.

The internal arrangement of the signal line drive circuit 200 will be described in reference to FIG. 3. As FIG. 3 illustrates, the signal line drive circuit 200 includes a shift register circuit 210 and a sampling circuit 230.

In the signal line drive circuit 200 with this arrangement, sampling pulse signals progressively supplied from the shift register circuit 210 are inputted to the gates of an analog switch group 240 composed of a plurality of analog switches for sampling, the analog switch group 240 being provided in the sampling circuit 230.

In accordance with the signals supplied to the gates, the analog switch group 240 for sampling connects one of the video lines 401-403 constituting the video signal input section 400 to a signal line 121 (see FIG. 2) connected to the display section 100. That is to say, the analog switch group 240 is turned ON at the time of receiving the sampling pulse, so as to sample the video signals. These video signals are supplied to the signal lines via the analog switch group 240 so as to be transmitted to the desired pixel display sections 140 (see FIG. 2).

Figure 3:
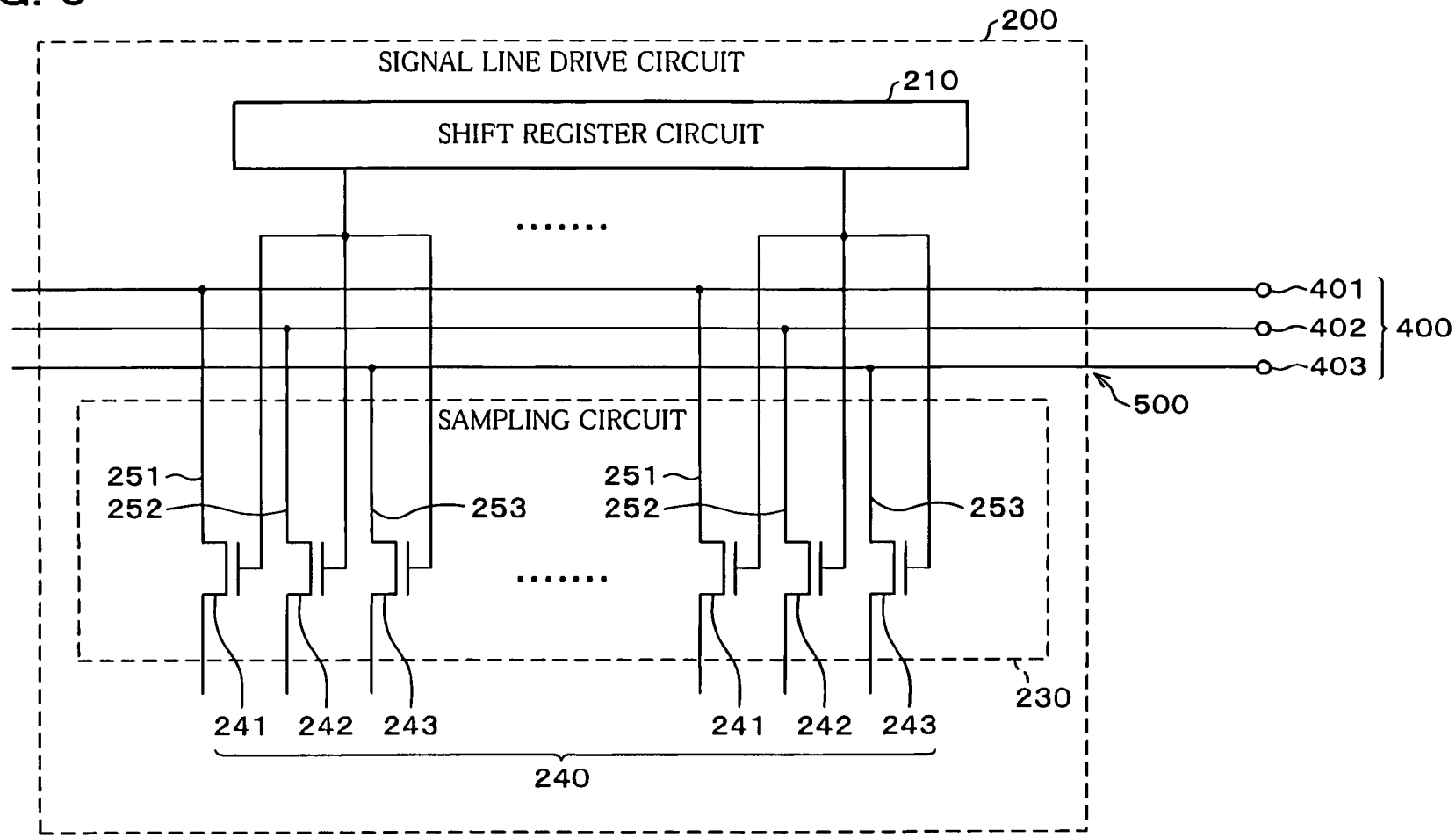
FIG. 3 is a schematic diagram, showing an example of a signal line drive circuit in the liquid crystal display apparatus of FIG. 1.

The signal line drive circuit illustrated in FIG. 3 shows an example of three-point simultaneous sampling, by which the sampling pulse signal outputted from the shift register circuit 210 is branched off and then simultaneously inputted to three analog switches 241-243 for sampling. In a word, in this example, a sampling pulse signal simultaneously activates the analog switches 241-243.

In FIG. 3, connecting lines 251-253 which connect three video lines 401-403 to three analog switches 241-243 have each different resistance, since the distance between the video line and the analog switch is different in each of the connecting lines 251-253. In the present example, the video line 401 is the furthest from the analog switches 241-243 so that the connecting line 251 which is the longest has the highest resistance. In contrast, the connecting line 253 is the shortest so as to have the lowest resistance. Assuming that the respective resistances of the connecting lines 251-253 are Rc1, Rc2, and Rc3, Rc1>Rc2>Rc3.

The video lines 401-403 are made of metals such as aluminum and hence the resistances thereof are lower than the resistances of the connecting lines 251-253. Meanwhile, the connecting lines 251-253 are composed of polycrystalline silicon thin films and hence the resistances thereof are (for instance, 50 times) higher than the resistances of the video lines 401-403. For this reason, the difference of the resistances between the video lines, which is due to the difference of the lengths and the widths of the lines, is less prominent than the difference of the resistances between the connecting lines, which is also due to the difference of the lengths and the widths of the lines.

On this account, the speed of transmitting the video signals is different in each of the connecting lines, when each of the connecting lines has a different resistance. That is to say, the amounts of the delay of video signals increase as the resistances of the lines increase, so that the timings to supply the video signals to the sampling circuit 230 are caused to be irregular. Thus, even if the sampling signals from the shift register circuit 210 are simultaneously outputted towards the gate electrodes of the analog switch group 240 of the sampling circuit 230, the input timings of the respective video signals are not simultaneous so that the non-uniformity of luminance looking like lines is generated and hence the display quality is degraded.

For this reason, as illustrated in FIG. 2, the present embodiment is arranged so as to include the delay adjustment section 500 for adjusting the amounts of the delay of the video signals, the delay being caused when passing through the video lines 401-403 of the video signal input section 400, i.e. caused before the input to the connecting lines.

The delay adjustment section 500 adjusts the amounts of the delay of the video signals to meet the following condition: the amount of the delay adjustment for the video line 401 which is connected to the longest connecting line 251 is the smallest while the amount of the delay adjustment for the video line 403 which is connected to the shortest connecting line 253 is the largest, i.e. the amount of the delay adjustment for the video line 401<the amount of the delay adjustment for the video line 402<the amount of the delay adjustment for the video line 403.

In practice, the resistances of the video lines are adjusted by adjusting either the lengths or the widths of the video lines thereof, so that the difference between the resistances Rc1-Rc3 of the respective connecting lines 251-253 is compensated by adjusting the amounts of the delay in the video lines.

Figure 4:
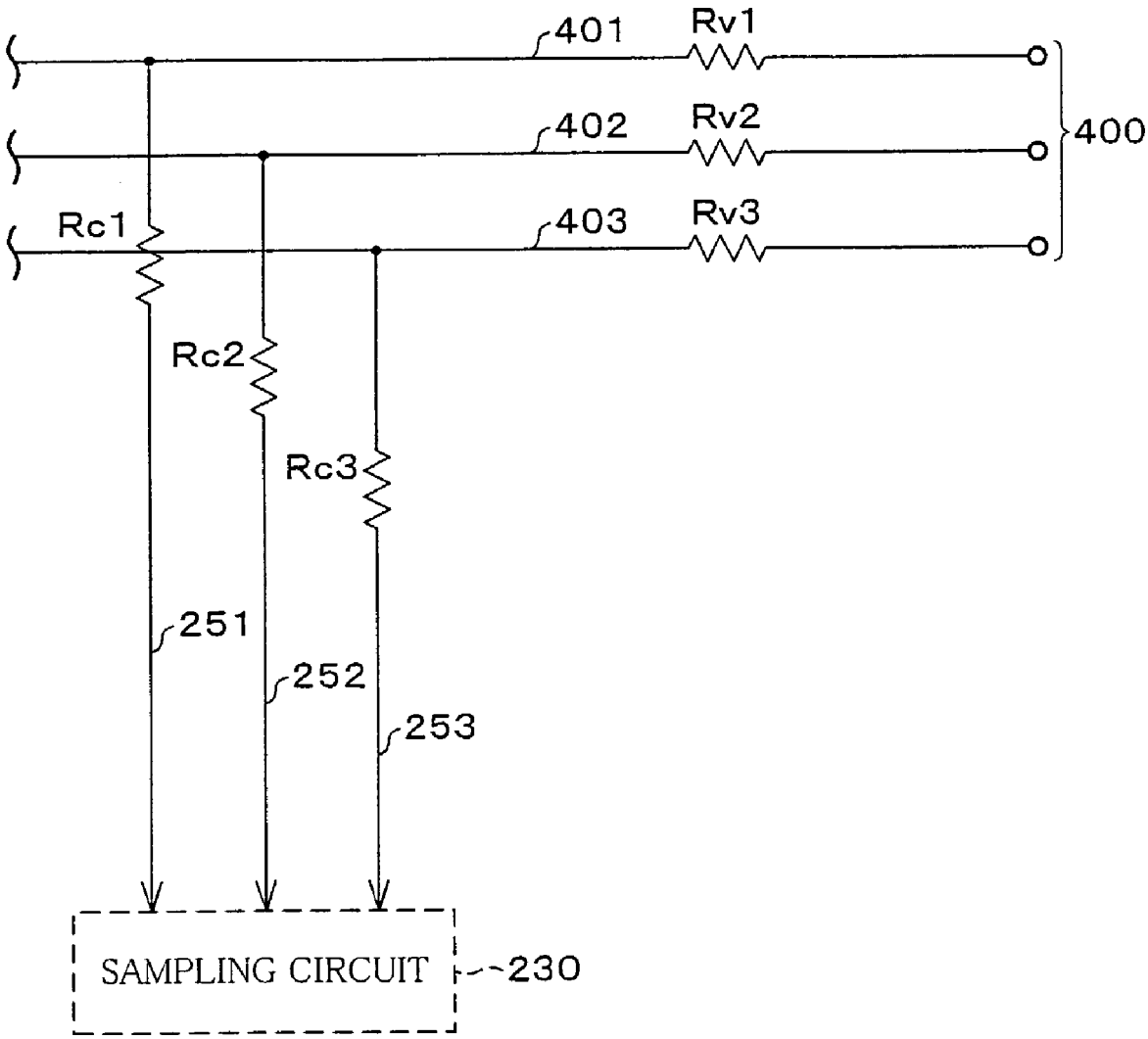
FIG. 4 illustrates an equivalent circuit indicating the relationship between video lines and connecting lines in the signal line drive circuit of FIG. 3.

FIG. 4 shows an equivalent circuit indicating the resistances of the respective video lines and the respective connecting lines. Assuming that the respective resistances of the video lines 401-403 are Rv1, Rv2, and Rv3, it is possible to adjust the amounts of the delay in the video lines so as to compensate the difference of the delay between the connecting lines connected to the respective video lines, by setting the resistances Rv1-Rv3 to meet the following equation (1).

$$Rv1+Rc1=Rv2+Rc2=Rv3+Rc3 \quad (1)$$

In this case, as in the foregoing description, the equation (1) can be met by adjusting either the lengths and/or the widths of the video lines. In other words, equation (1) can be met by adjusting (i) either the lengths or the widths of the video lines, or (ii) the combination of the lengths and the widths of the video lines.

The signal line drive circuit 200 is comprised of a plurality of switch groups for sampling, each of the switch groups being operated by a sampling pulse supplied from a single stage of the shift register circuit. The resistances are compensated before inputting the sampling pulses to the sampling circuit 230 of the signal line drive circuit 200 as described above so that equation (1) is met in all of the circuit blocks, and hence it is possible to arrange all pathways of the video signals, which are from the video lines 401-403 of the video signal input sections 400 to the analog switches via the connecting lines, to have an equal resistance.

Even if the arrangement of the connecting lines and the resistances thereof are changed, similar effects can be obtained as long as equation (1) is met. For this reason, it is possible to flexibly design the layout in consideration of an available space, and this enables to find an optimum arrangement. In particular, when the active matrix liquid crystal display apparatus of the present embodiment is adopted as a high-resolution display apparatus with not more than 20 μm pixel spacing, it is assumed that the design flexibility of the signal line drive circuit is significantly restrained. However, since the lengths and the widths of the connecting lines can be flexibly chosen, it is possible to easily realize the optimal arrangement of the pathways of the video signals in totality. Thus, thanks to the design flexibility and the easiness of realizing the optimal arrangement, the display apparatus in accordance with the present embodiment can keep up with high-speed sampling and hence can realize displaying with higher resolution.

Although meeting equation (1) is the most preferable, it is possible to sufficiently improve the display quality through the compensation of the difference of the delay between the connecting lines, compared to conventional display apparatuses, by setting the resistances Rv1-Rv3 of the respective video lines 401-403 to meet the following set of inequality (2) when the resistances Rc1-Rc3 of the respective connecting lines 251-253 are Rc1>Rc2>Rc3.

$$Rc1>Rc2>Rc3 \text{ and}$$

$$Rv1<Rv2<Rv3 \quad (2)$$

When Rc1<Rc2<Rc3, the resistances Rv1-Rv3 of the video lines 401-403 may be arranged so as to meet the following set of inequality (2)'.

$$Rc1<Rc2<Rc3 \text{ and}$$

$$Rv1>Rv2>Rv3 \quad (2)'$$

The foregoing example regards to the three-point simultaneous sampling. On the occasion of multipoint simultaneous sampling, i.e. n-point simultaneous sampling (n>0), the resistances of the respective video lines are set so as to meet either one of following two sets of inequalities (3) and (3)'.

$$Rc1>Rc2>Rc3 \ldots >Rcn \text{ and}$$

$$Rv1<Rv2<Rv3 \ldots <Rvn \quad (3)$$

and $$Rc1<Rc2<Rc3 \ldots <Rcn \text{ and}$$

$$Rv1>Rv2>Rv3 \ldots >Rvn \quad (3)'$$

Also in this case, it is possible to sufficiently improve the display quality compared to conventional display apparatuses, by setting the resistances of the respective video lines to meet either of the foregoing sets of inequalities (3) and (3)'. However, meeting the following equation (4) is more preferable.

$$Rv1+Rc1=Rv2+Rc2=Rv3+Rc3 \ldots =Rvn+Rcn \quad (4)$$

The present embodiment has described the example of adjusting the widths and the lengths of the video lines 401-403 of the video signal input section 400 in order to compensate the difference of the resistances of the pathways from the video signal input section 400 to the sampling circuit 230 of the signal line drive circuit 200. Now, the following Embodiment 2 will describe an example in which resistors (compensating resistors) are alternatively or additionally provided to the respective video lines 401-403.

Embodiment 2

Another embodiment of the present invention will be described as below.

Figure 5:
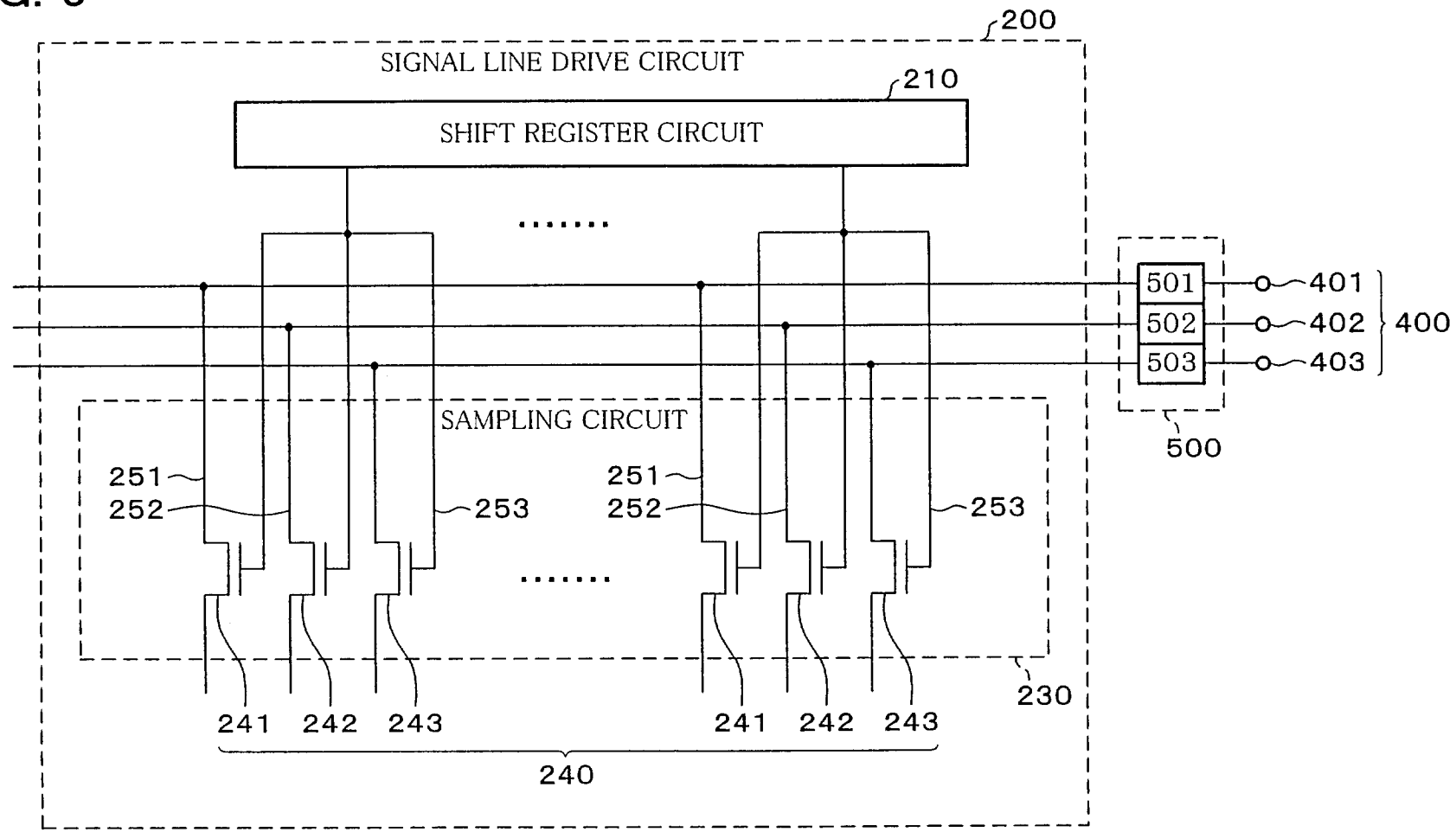
FIG. 5 is a schematic diagram, showing another example of the signal line drive circuit in the liquid crystal display apparatus of FIG. 1.

A display apparatus in accordance with the present embodiment includes a signal line drive circuit 200 as illustrated in FIG. 5. This signal line drive circuit 200 is arranged more or less identical with the same in Embodiment 1, except that the delay adjustment section 500 is comprised of resistors (compensating resistors) which are additionally provided members, rather than arranged by adjusting the widths and the lengths of the video lines 401-403. Accordingly, members other than the delay adjustment section 500 in the signal line drive circuit 200 are identical with those of the display apparatus in Embodiment 1 so as not to be specifically described in the present embodiment.

As illustrated in FIG. 5, the delay adjustment section 500 is composed of compensating resistors 501, 502, and 503 which are electrically connected to the respective video lines 401-403. These compensating resistors 501-503 are comprised of lines formed on a layer different from the layer on which the video lines 401-403 are formed.

In the present embodiment, the compensating resistors 501-503 are provided on the video lines 401-403 before the input of video signals to a sampling circuit 230 of the signal line drive circuit 200, in order to compensate the difference between the resistances Rc1-Rc3 of respective connecting lines 251-253.

Figure 6:
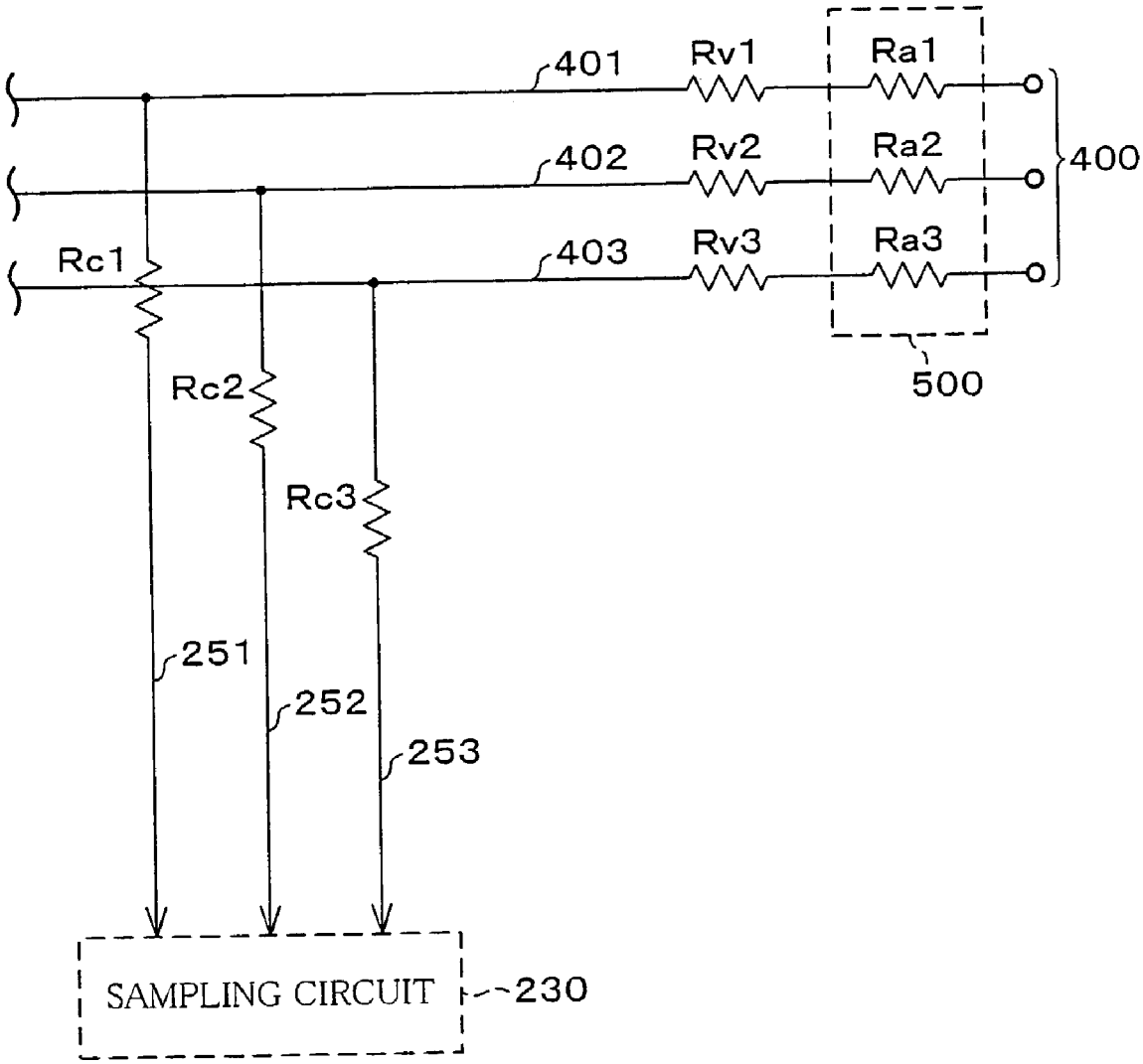
FIG. 6 illustrates an equivalent circuit indicating the relationship between video lines and connecting lines in the signal line drive circuit of FIG. 5.
Figure 7:
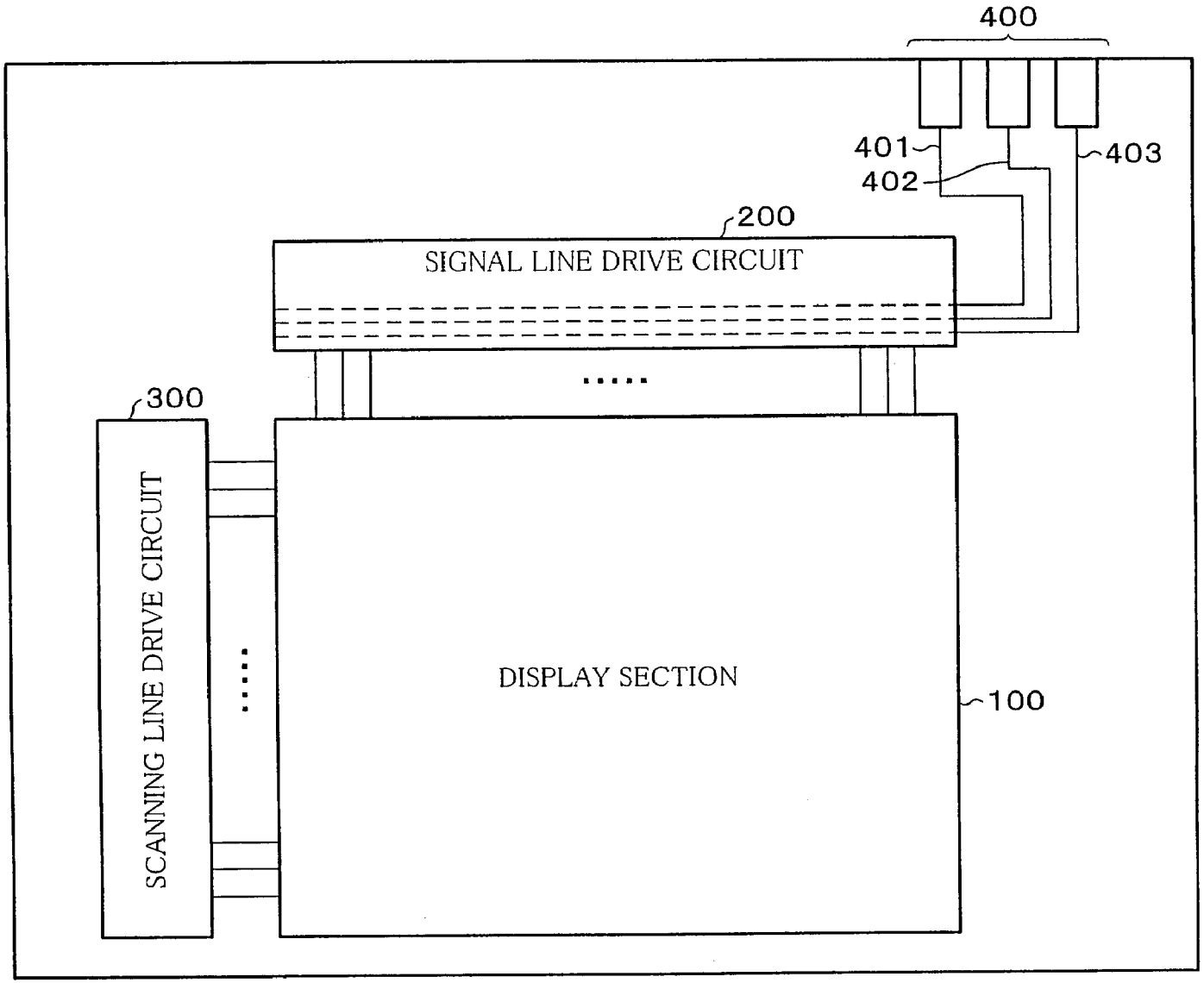
FIG. 7 illustrates a schematic arrangement of a conventional liquid crystal display apparatus.
Figure 8:
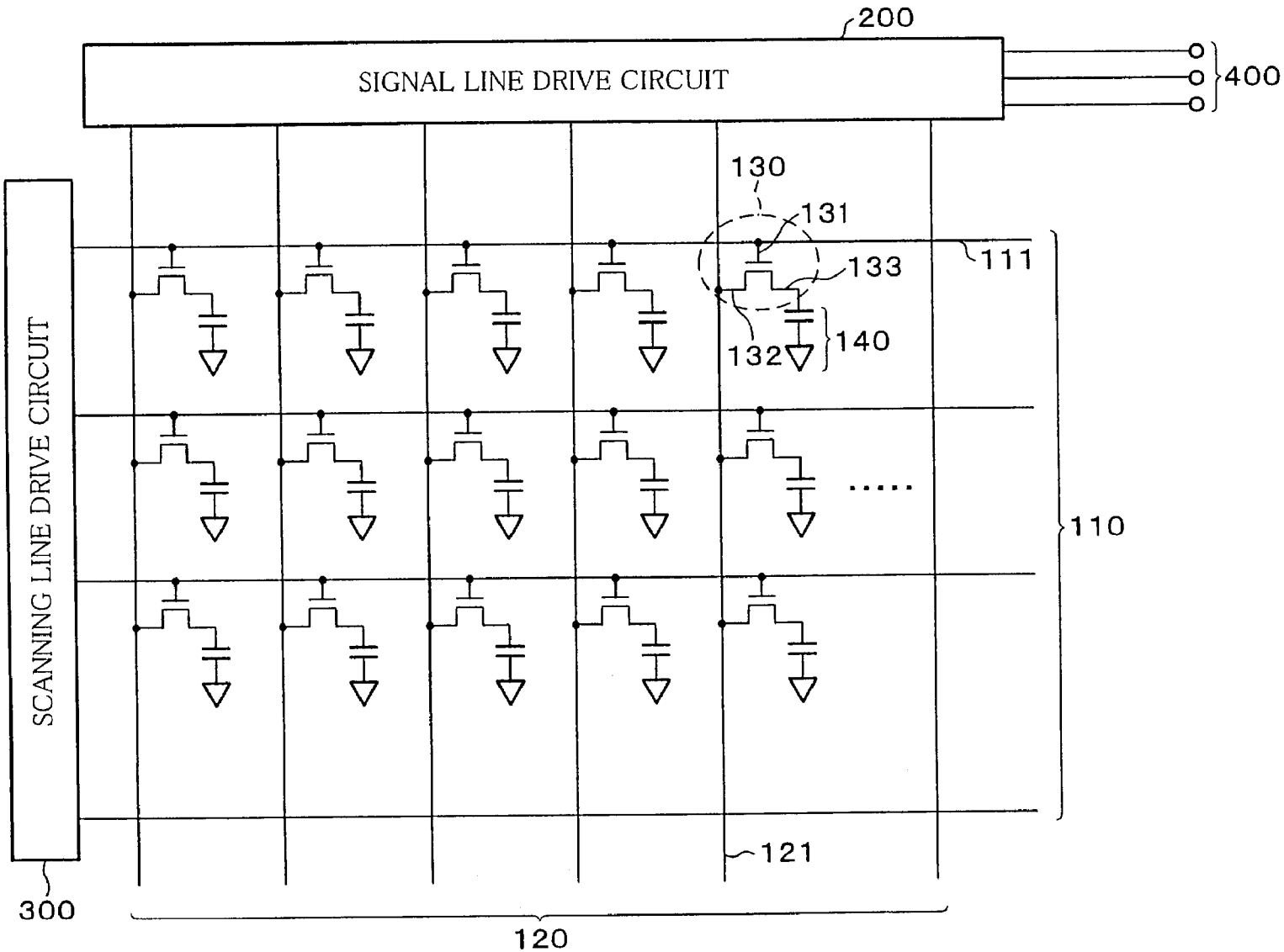
FIG. 8 is a view, schematically illustrates an arrangement of drive circuits and a display section in the liquid crystal display apparatus of FIG. 7.
Figure 9:
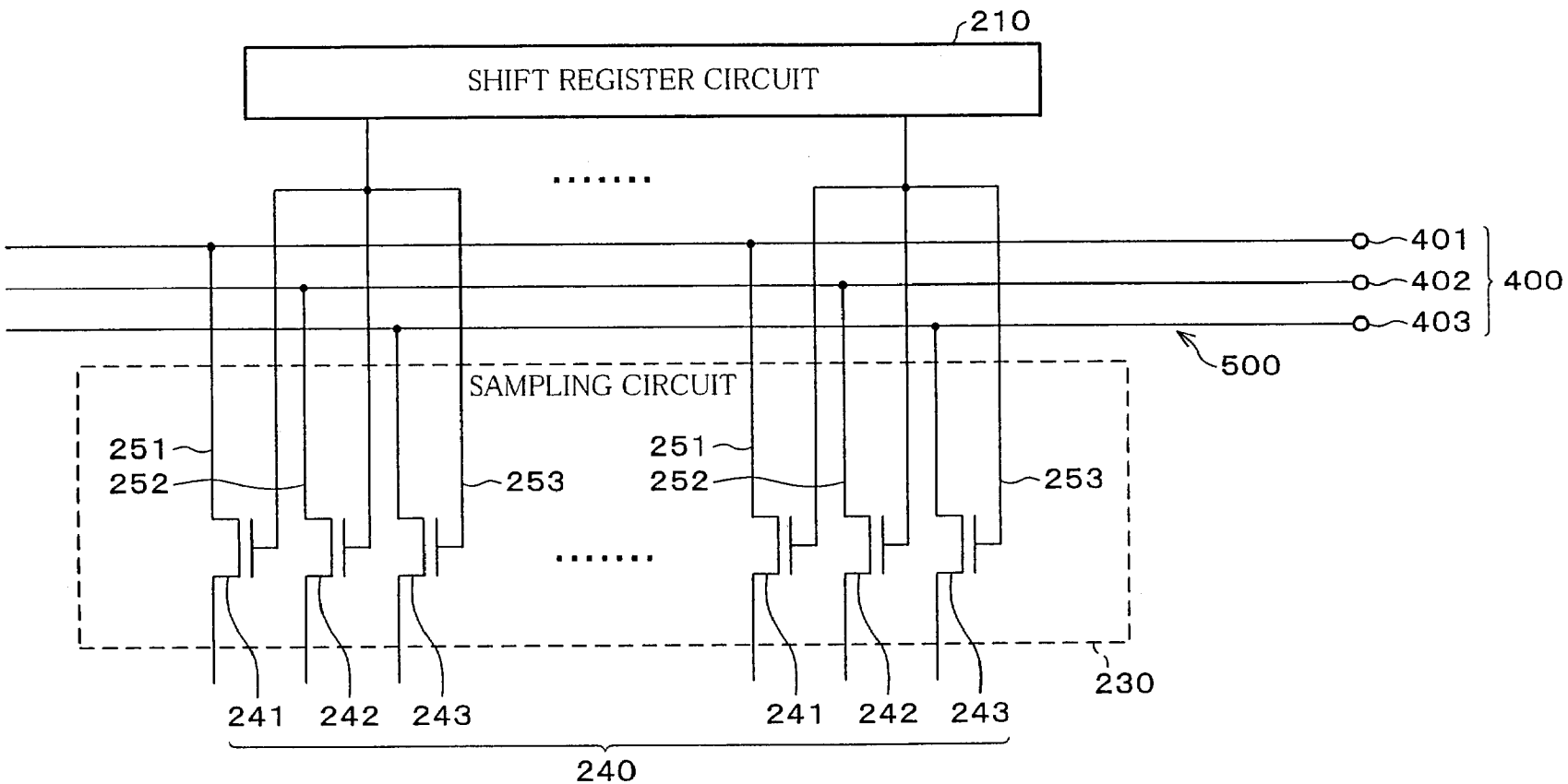
FIG. 9 is a schematic diagram, illustrating a signal line drive circuit in the liquid crystal display apparatus of FIG. 7.

FIG. 6 shows an equivalent circuit indicating the resistances of the video lines, the respective compensating resistors, and the connecting lines. Provided that the resistances of the video lines 401-403 are Rv1, Rv2, and Rv3 and the resistances of the respective compensating resistors 501-503 are Ra1, Ra2, and Ra3, it is possible to adjust the amounts of the delay in the respective video lines so as to compensate the difference of the delay between the respective connecting lines connected to the video lines, by setting the resistances Ra1-Ra3 of the respective compensating resistors 501-503 to meet the following equation (5).

$$Rv1+Ra1+Rc1=Rv2+Ra2+Rc2=Rv3+Ra3+Rc3 \quad (5)$$

The compensating resistors 501-503 are preferably formed on the same layer as the connecting lines in order to simplify the fabricating process, but the compensating resistors may be formed on another conductive layer. Since the compensating resistors 501-503 are formed on a layer different from the layer of the video lines 401-403, it is necessary to electrically connect the resistors to the video lines through a contact hole. If the resistances Ra1-Ra3 of the compensating resistors are figured out in consideration of the contact resistance generated on this occasion, it is possible to adjust the resistances more precisely.

Incidentally, in order to reduce the resistances as much as possible, for instance, it is possible to remove the compensating resistor 501 connected to the video line 401 which is the furthest among the video lines 401-403 from analog switches for sampling, and adjust the resistances using the remaining compensating resistors 502 and 503.

As in Embodiment 1, the signal line drive circuit 200 in accordance with the present embodiment is composed of a plurality of switch groups for sampling, each of the switch groups being operated by sampling pulses supplied from a single stage of the shift register circuit. The resistances are compensated before inputting the sampling pulses to the sampling circuit 230 of the signal line drive circuit 200 as described above so that the equation (5) is met in all of the circuit blocks, and hence it is possible to arrange all pathways of the video signals, which are from the video lines 401-403 of the video signal input sections 400 to the analog switches of the sampling circuit 230 via the connecting lines 251-253, to have equal resistances.

Also as in Embodiment 1, even if the arrangement of the connecting lines and the resistances thereof are changed, it is possible to obtain similar effects as long as the equation (5) is met, and this enables to flexibly design the signal line drive circuit 200.

Although meeting equation (5) is the most preferable, to compensate the difference of the delay between the connecting lines, it is possible to set the resistances Ra1-Ra3 of the respective compensating resistors 501-503 to meet at least the following set of inequalities (6) when the resistances Rc1-Rc3 of the respective connecting lines 251-253 are Rc1>Rc2>Rc3.

$$Rc1>Rc2>Rc3 \text{ and}$$

$$Ra1<Ra2<Ra3 \quad (6)$$

Alternatively, when Rc1<Rc2<Rc3, the resistances Ra1-Ra3 of the respective compensating resistors 501-503 may be arranged so as to meet the following set of inequalities (6)'.

$$Rc1<Rc2<Rc3 \text{ and}$$

$$Ra1>Ra2>Ra3 \quad (6)'$$

Here, being different from the connecting lines, the video lines 401-403 are made of materials with low resistance such as aluminum so that the resistances Rv1-Rv3 of the video lines 401-403 themselves are Rv1=Rv2=Rv3. On this account, there is no need to indicate anything other than the relationship of resistances Ra1-Ra3 of the respective compensating resistors 501-503, in the case of either one of two sets of inequalities (6) and (6)'.

In this manner, it is possible to sufficiently improve the display quality compared to conventional display apparatuses, only by setting the resistances Ra1-Ra3 of the respective compensating resistors 501-503 to meet either one of two sets of inequalities (6) and (6)'.

The foregoing example regards to the three-point simultaneous sampling. On the occasion of multipoint simultaneous sampling, i.e. n-point simultaneous sampling (n>0), the resistances of the respective compensating resistors are set so as to meet either one of following two sets of inequalities (7) and (7)'.

$$Rc1>Rc2>Rc3 \ldots >Rcn \text{ and}$$

$$Ra1<Ra2<Ra3 \ldots <Ran \quad (7)$$

and $$Rc1<Rc2<Rc3 \ldots <Rcn \text{ and}$$

$$Ra1>Ra2>Ra3 \ldots >Ran \quad (7)'$$

Also in this case, it is possible to sufficiently improve the display quality compared to conventional display apparatuses, by setting the resistances of the respective compensating resistors to meet either the inequalities (7) or the inequalities (7)'. However, meeting the following equation (8) is more preferable.

$$Rv1+Rc1+Ra1=Rv2+Rc2+Ra2=Rv3+Rc3+Ra3=\ldots=Rvn+Rcn+Ran \quad (8)$$

Embodiments 1 and 2 have described the examples of adjusting the amounts of the delay of video signals supplied to connecting lines from video lines, by adjusting the resistances of the respective video lines and the respective connecting lines. Now, the following embodiment illustrates an example in which the parasitic capacitances of the video lines and the connecting lines are also taken into account.

Embodiment 3

Referring to FIGS. 1-5, a further embodiment of the present invention will be described as below.

The arrangement of a display apparatus in accordance with the present embodiment is similar to the display apparatuses in Embodiments 1 and 2 as FIG. 1 indicates, except that the adjustment of the delay of video signals by a delay adjustment section 500 is carried out with a higher degree of precision, in consideration of not only the resistances of video lines and connecting lines but also the parasitic capacitances of the video lines and the connecting lines. Thus, an overall arrangement of the display apparatus and arrangements regarding a signal line drive circuit are substantially identical with those in Embodiments 1 and 2 and hence the descriptions thereof are omitted.

In the present embodiment, the equations and the sets of inequalities described in Embodiments 1 and 2 are replaced with equations and the sets of inequalities which take the parasitic capacitances into account so that the resistance adjustment with a higher degree of precision can be realized in the pathways from the video lines to a sampling circuit 230 via the connecting lines. On this account, the followings are described as variations of respective Embodiments 1 and 2.

First, to describe a variation of Embodiment 1, assume that the parasitic capacitances regarding connecting lines 251-253 are Cc1, Cc2, and Cc3, the parasitic capacitances regarding video lines 401-403 are Cv1, Cv2, and Cv3, and the load capacitance regarding the sampling circuit 230 is Csl. In this case, the equation (1) described in Embodiment 1 is altered to the following equation (9).

$$Rv1\times(Cv1/2+Cc1+Csl)+Rc1\times(Cc1/2+Csl)=Rv2\times(Cv2/2+Cc2+Csl)+Rc2\times(Cc2/2+Csl)=Rv3\times(Cv3/2+Cc3+Csl)+Rc3\times(Cc3/2+Csl) \quad (9)$$

When the widths or the lengths of the video lines 401-403 are adjusted in order to meet this equation (9), it is considered that the parasitic capacitances of the video lines 401-403 and the parasitic capacitances of the connecting lines are taken into consideration and hence the display quality can be further improved. That is to say, since the parasitic capacitances and the resistances of the pathways from the video lines to the sampling circuit 230 via the connecting lines are adjusted so as to equalize the time of the delay regarding each of the pathways, it is possible to realize the pathways which are substantially identical to each other, as distributed constant circuits each including the parasitic capacitance and the resistance. Here, the load capacitance regarding the sampling circuit 230 is figured out as the sum total of the capacities of the sampling switches (ON capacities) and the capacities of the signal lines. It is noted that when the load capacitance does not really influence on the result, the equation can be approximated without considering the load capacitance.

With this arrangement, the difference of the delay between the video signals passing through the connecting lines is certainly eliminated so that the display quality can be further improved.

As in Embodiment 1, although meeting the equation (9) is the most preferable in the present embodiment, it is possible to sufficiently improve the display quality through the compensation of the difference of the delay between the connecting lines, compared to conventional display apparatuses, by setting the resistances Rv1-Rv3 of the respective video lines 401-403 to cause the time constants of the video lines 401-403 to meet the following set of inequalities (10) when the time constants of the respective connecting lines 251-253 are arranged as Rc1×Cc1>Rc2×Rc2>Rc3×Cc3.

$$Rc1\times(Cc1/2+Csl)>Rc2\times(Cc2/2+Csl)>Rc3\times(Cc3/2+Csl)$$

and $$Rv1\times(Cv1/2+Cc1+Csl)<Rv2\times(Cv2/2+Cc2+Csl)<Rv3\times(Cv3/2+Cc3+Csl) \quad (10)$$

Alternatively, when Rc1×Cc1<Rc2×Cc2<Rc3×Cc3, the resistances Rv1-Rv3 of the respective video lines 401-403 may be set so as to cause the time constants of the respective video lines 401-403 to meet the following set of inequalities (10)'.

$$Rc1\times(Cc1/2+Csl)<Rc2\times(Cc2/2+Csl)<Rc3\times(Cc3/2+Csl)$$

and $$Rv1\times(Cv1/2+Cc1+Csl)>Rv2\times(Cv2/2+Cc2+Csl)>Rv3\times(Cv3/2+Cc3+Csl) \quad (10)'$$

The foregoing example describes the case of three-point simultaneous sampling. In the case of multipoint simultaneous sampling, i.e. n-point simultaneous sampling (n>0), the resistances of the video lines are set so as to meet either the set of inequalities (11) or the set of inequalities (11)' below.

$$If:\ Rc1\times(Cc1/2+Csl)>Rc2\times(Cc2/2+Csl)>Rc3\times(Cc3/2+Csl)\ \ldots\ >Rcn\times(Ccn/2+Csl),$$

$$Rv1\times(Cv1/2+Cc1+Csl)<Rv2\times(Cv2/2+Cc2+Csl)<Rv3\times(Cv3/2+Cc3+Csl)\ \ldots\ <Rvn\times(Cvn/2+Ccn+Csl) \quad (11)$$

or $$If:\ Rc1\times(Cc1/2+Csl)<Rc2\times(Cc2/2+Csl)<Rc3\times(Cc3/2+Csl)\ \ldots\ <Rcn\times(Ccn/2+Csl),$$

$$Rv1\times(Cv1/2+Cc1+Csl)>Rv2\times(Cv2/2+Cc2+Csl)>Rv3\times(Cv3/2+Cc3+Csl)\ \ldots\ >Rvn\times(Cvn/2+Ccn+Csl) \quad (11)'$$

Also in this case, adjusting the resistances of the video lines in order to meet either the set of inequalities (11) or the set of inequalities (11)' enables to sufficiently improve the display quality compared to conventional display apparatuses. However, meeting the following equation (12) is more preferable.

$$Rv1\times(Cv1/2+Cc1+Csl)+Rc1\times(Cc1/2+Csl)=Rv2\times(Cv2/2+Cc2+Csl)+Rc2\times(Cc2/2+Csl)=\ \ldots\ =Rvn\times(Cvn/2+Ccn+Csl)+Rcn\times(Ccn/2+Csl) \quad (12)$$

Next, to describe a variation of Embodiment 2, assume that the parasitic capacitances of the respective connecting lines 251-253 are Cc1, Cc2, and Cc3, the parasitic capacitances of the respective video lines 401-403 are Cv1, Cv2, and Cv3, and the parasitic capacitances of the respective compensating resistors 501-503 are Ca1, Ca2, and Ca3. In this case, the equation (5) described in Embodiment 2 is replaced with the following equation (13).

$$Ra1\times(Ca1/2+Cv1+Cc1+Csl)+Rv1\times(Cv1/2+Cc1+Csl)+Rc1\times(Cc1/2+Csl)=Ra2\times(Ca2/2+Cv2+Cc2+Csl)+Rv2\times(Cv2/2+Cc2+Csl)+Rc2\times(Cc2/2+Csl)=Ra3\times(Ca3/2+Cv3+Cc3+Csl)+Rv3\times(Cv3/2+Cc3+Csl)+Rc3\times(Cc3/2+Csl) \quad (13)$$

The layout of the compensating resistors 501-503 is altered in order to meet this equation (13). In practical terms, there is an option to form the compensating resistors 501-503 on a layer different from the layer of the video lines 401-403 as described in Embodiment 2. In this case, it is possible to easily adjust the capacities by changing the degree of overlapping between the compensating resistors 501-503 and the corresponding video lines 401-403.

As in Embodiment 2, meeting the equation (13) is the most preferable in the present embodiment, too. However, it is possible to sufficiently improve the display quality through the compensation of the difference of the delay between the connecting lines, compared to conventional display apparatuses, by setting the resistances Ra1-Ra3 of the respective compensating resistors 501-503 to cause the time constants of the respective compensating resistors 501-503 to meet the following set of inequalities (14) when the time constants of the respective connecting lines 251-253 are arranged as Rc1×Cc1>Rc2×Cc2>Rc3×Cc3.

$$Rc1\times(Cc1/2+Csl)>Rc2\times(Cc2/2+Csl)>Rc3\times(Cc3/2+Csl)$$

and $$Ra1\times(Ca1/2+Cv1+Cc1+Csl)<Ra2\times(Ca2/2+Cv2+Cc2+Csl)<Ra3\times(Ca3/2+Cv3+Cc3+Csl) \quad (14)$$

Alternatively, when Rc1×Cc1<Rc2×Cc2<Rc3×Cc3, the resistances Ra1-Ra3 of the respective compensating resistors 501-503 may be set so as to meet the following set of inequalities (14)'.

$$Rc1\times(Cc1/2+Csl)<Rc2\times(Cc2/2+Csl)<Rc3\times(Cc3/2+Csl)$$

and $$Ra1\times(Ca1/2+Cv1+Cc1+Csl)>Ra2\times(Ca2/2+Cv2+Cc2+Csl)>Ra3\times(Ca3/2+Cv3+Cc3+Csl) \quad (14)'$$

Here, being different from the connecting lines, the video lines 401-403 are made of materials with low resistance such as aluminum so that the resistances Rv1-Rv3 of the video lines 401-403 themselves are Rv1=Rv2=Rv3 and hence the parasitic capacitances are Cv1=Cv2=Cv3. Thus, in either one of two sets of inequalities (14) and (14)', it is not necessary to express the terms regarding Rv.

As described above, compared to conventional display apparatuses, it is possible to sufficiently improve the display quality only by setting the values of the resistances Ra1-Ra3, which determine the time constants of the respective compensating resistors 501-503, to meet either the set of inequalities (14) or the set of inequalities (14)'.

The foregoing example regards to the three-point simultaneous sampling. On the occasion of multipoint simultaneous sampling, i.e. n-point simultaneous sampling (n>0), the resistances of the respective compensating resistors are set so as to meet either one of following two sets of inequalities (15) and (15)'.

$$Rc1\times(Cc1/2+Csl)>Rc2\times(Cc2/2+Csl)>Rc3\times(Cc3/2+Csl)\ \ldots\ >Rcn\times(Ccn/2+Csl)$$

and $$Ra1\times(Ca1/2+Cv1+Cc1+Csl)<Ra2\times(Ca2/2+Cv2+Cc2+Csl)<Ra3\times(Ca3/2+Cv3+Cc3+Csl)\ \ldots\ <Ran\times(Can/2+Cvn+Ccn+Csl) \quad (15)$$

or $$Rc1\times(Cc1/2+Csl)<Rc2\times(Cc2/2+Csl)<Rc3\times(Cc3/2+Csl)\ \ldots\ <Rcn\times(Ccn/2+Csl)$$

and $$Ra1\times(Ca1/2+Cv1+Cc1+Csl)>Ra2\times(Ca2/2+Cv2+Cc2+Csl)>Ra3\times(Ca3/2+Cv3+Cc3+Csl)\ \ldots\ >Ran\times(Can/2+Cvn+Ccn+Csl) \quad (15)'$$

Also in this case, it is possible to sufficiently improve the display quality by setting the resistances of the respective compensating resistors to meet either one of two sets of inequalities (15) and the inequalities (15)', compared to conventional display apparatuses. However, meeting the following equation (16) is more preferable.

$$Ra1\times(Ca1/2+Cv1+Cc1+Csl)+Rv1\times(Cv1/2+Cc1+Csl)+Rc1\times(Cc1/2+Csl)=Ra2\times(Ca2/2+Cv2+Cc2+Csl)+Rv2\times(Cv2/2+Cc2+Csl)+Rc2\times(Cc2/2+Csl)=Ra3\times(Ca3/2+Cv3+Cc3+Csl)+Rv3\times(Cv3/2+Cc3+Csl)+Rc3\times(Cc3/2+Csl)=Ran\times(Can/2+Cvn+Ccn+Csl)+Rvn\times(Cvn/2+Ccn+Csl)+Rcn\times(Ccn/2+Csl) \quad (16)$$

Incidentally, it is noted that because of the glowing popularity of circuit design using computer simulation, it has become possible to achieve the foregoing optimum design by carrying out the circuit simulation of the pathways of video signals, without actually figuring out the results of the above-mentioned equations and the sets of inequalities (9)-(16) which take the time constants into consideration. In particular, the computer simulation can be effectively used for figuring out the foregoing parasitic capacitances so that it is possible to obtain the effects similar to those achieved by the embodiments above.

According to the foregoing arrangement, delay means for causing the delay of the video signals which pass through the video lines is provided for compensating the difference of the delay between the video signals passing through the connecting lines, and hence the connecting lines receive the video signals which have been delayed in advance. In other words, the difference of the resistances between the respective pathways of the video signals from the video lines to the sampling means via the connecting lines is compensated by delaying the video signals passing through the video lines.

With this arrangement, the video signals passing through the video lines are delayed by the delay means in order to compensate the delay caused by the difference of the resistances between the connecting lines, the difference of the resistances being predominantly caused in accordance with the difference of the lengths of the connecting lines, so that it is possible to almost simultaneously input the video signals from the connecting lines to the sampling means.

Thus, since the delay of the video signals occurring on the pathways from the video lines to the sampling means is compensated, the non-uniformity of luminance looking like lines, the non-uniformity being generated due to the difference of the delay between the video signals on the occasion of being inputted to the sampling means, is eliminated so that it is possible to improve the display quality.

Moreover, with this arrangement, the difference of the delay between the video signals passing through the connecting lines, i.e. the difference of the resistances caused by the difference of the lengths of the connecting lines is compensated by adjusting the amounts of the delay of the video signals passing through the video lines, without changing the widths and the lengths of the connecting lines. For this reason, it is possible to obtain the design flexibility of the connecting lines and the sampling means.

That is to say, in the present invention, rather than the adjustment of the internal arrangement of the signal line drive circuit, the layouts of the pathways of the video signals before entering the signal line drive circuit, i.e. the layouts of the video lines are ingeniously arranged, and this enables to adjust the resistances of the respective pathways of the video signals from the video lines to the sampling circuit via the connecting lines, without requiring the major changes of the arrangement when compared to conventional signal line drive circuits, so that it is possible to obtain the design flexibility.

In this manner, since it is unnecessary to arrange the connecting lines and the sampling means in an over-elaborated manner, it is possible to optimally design the pixel display sections especially in the case of display apparatuses requiring high-speed sampling, such as high-resolution display apparatuses with not more than 20 μm pixel spacing. On this account, it is possible to eliminate the non-uniformity of luminance looking like lines so as to obtain good display quality, while the high-speed sampling being realized at the same time.

It is noted that although the embodiments above illustrate that the outputs branched from the shift register circuit 210 are directly supplied to the sampling circuit 230, the present invention can realize identical effects when adopted to any types of circuit arrangements using the method of multipoint simultaneous sampling.

Moreover, in the present invention, the amounts of the delay of the video signals are adjusted when the same are passing through the video lines, in order to input the video signals at the timings of switching ON/OFF the sampling circuit by supplying sampling signals. Thus, the present invention can be adopted not only to the aforementioned multipoint simultaneous sampling but also to point-at-a-time sampling. Also in the case of this point-at-a-time sampling, since video signals can be inputted at timings of inputting sampling signals to a sampling circuit, it is possible to provide a display apparatus which can carry out high-quality display without the non-uniformity of luminance looking like lines.

Further, although the foregoing embodiments illustrate analog switches composed of single-channel (NMOS or PMOS) TFTs, the present invention is not limited to this arrangement and hence it is possible to obtain similar effects by adopting CMOS analog switches.

Moreover, although the foregoing embodiments illustrate that the signal drive circuit 200 is provided on the substrate on which the display section 100 and the scanning line drive circuit 300 are also provided, it is possible to adopt the present invention even if the shift register circuit 210 which is a part of the signal line drive circuit 200 is provided on another substrate.

This proves that the present invention can be adopted when at least a display section, a scanning line drive circuit, video lines, and a sampling circuit are integrally formed on a single substrate.

Although the foregoing embodiments discuss analog drive circuits to which analog signals are mainly supplied as video signals, the present invention is not limited to this arrangement so that the present invention can be adopted to digital drive circuits. That is to say, even when digital signals are supplied as video signals, the present invention can be easily applied for digital circuits when speedy operation is required and the timings of the operation may be important factors.

In other words, a basic circuit arrangement of the analog driver (sampling means) of the present invention can be adopted to digital drivers, provided that the inputted video signals are sampled in each stage. In this case, the aforementioned analog driver can be converted to a digital driver by adding members such as a latch circuit and a D/A converter to the same. Here, it is possible to see the driver with these members as sampling means.

For instance, in the case of conventional digital drivers, there have been problems of signal delay at the section from which a digital signal is inputted. More specifically, there have been two problems: The first problem is poor-quality display looking like lines occurring at the section of carrying out multipoint simultaneous sampling such as RGB, due to the mis-input of a signal of a neighboring line as in the case of the analog driver. The second problem is such that a desired video signal is not displayed because the period of delay is changed in each bit so that an erroneous digital signal is inputted, occurring at the section where the input of n bits is carried out.

Since these problems are all caused by the sampling of the inputted video signals at inappropriate timings, the present invention which is done for sampling inputted video signals at appropriate timings can effectively solve the foregoing problems of the digital drivers.

Further, the present invention can be generally adopted to driver-monolithic display apparatuses such as EL display apparatuses, along with the liquid crystal display apparatuses described as a display apparatus in the aforementioned embodiments. Thus the present invention can realize effects similar to those described in the aforementioned embodiments, when adopted to the driver-monolithic display apparatuses.

The present invention discussed as above can be adopted to any kinds of display apparatuses as long as pixel display sections and a sampling circuit which is one of drive circuits are integrally formed on a single substrate, and hence, for instance, the present invention is suitably adopted to liquid crystal display apparatuses.

Moreover, when a liquid crystal display apparatus is used for magnified projection as in the case of projection apparatuses, it is necessary to use a liquid crystal display apparatus with high resolution and high display quality in order to realize high-resolution and high-quality projection display.

An arrangement of a projection apparatus provided with the liquid crystal display apparatus of the present invention will be described in reference to FIG. 10.

Figure 10:
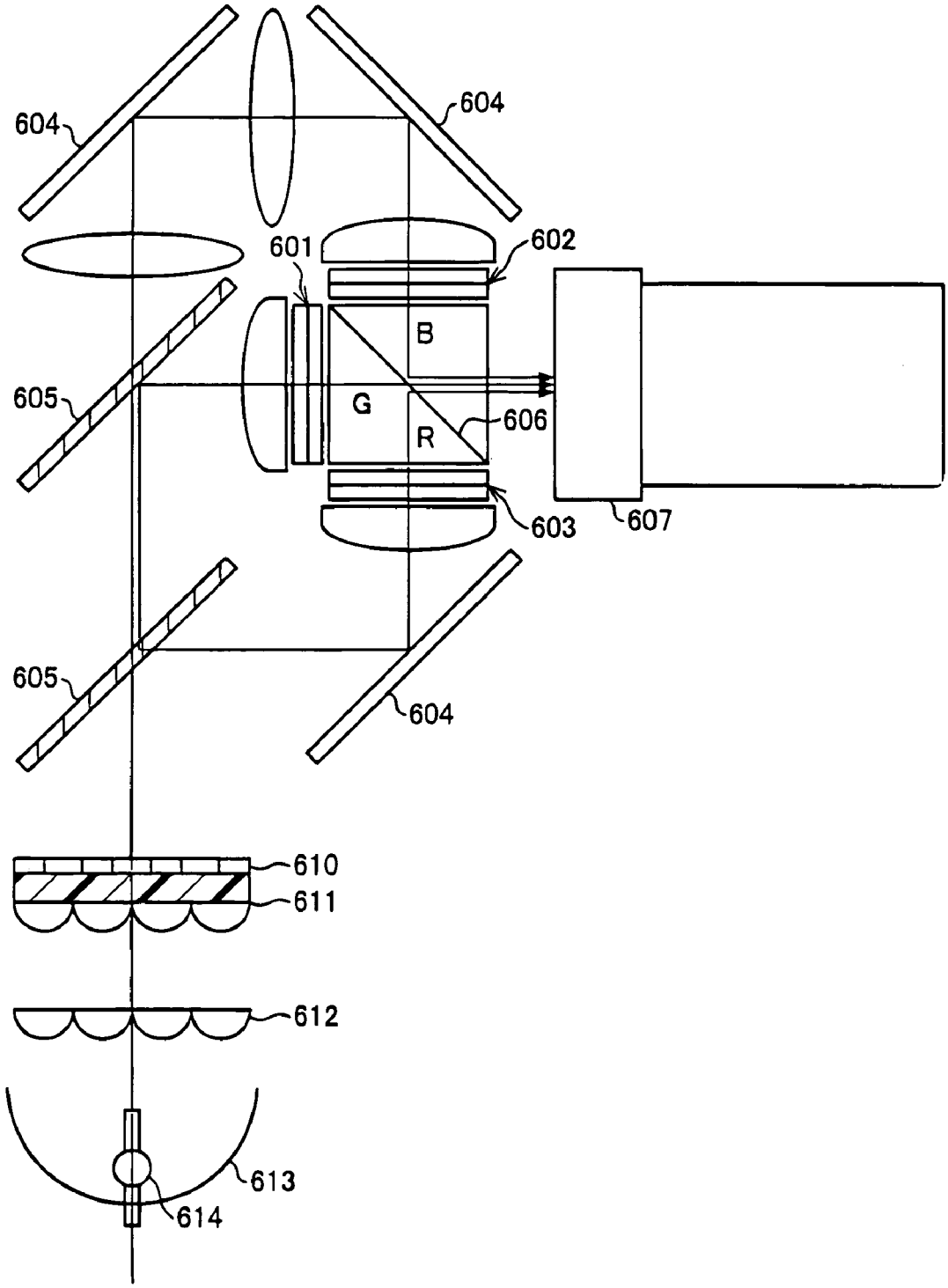
FIG. 10 is a schematic diagram, illustrating a three-panel type liquid crystal projection apparatus.

The projection apparatus illustrated in FIG. 10 is a so-called three-panel type liquid crystal projection apparatus including liquid crystal panels 601, 602, and 603 which correspond to the respective colors of R, G, and B and are the liquid crystal display apparatuses adopting the present invention. The projection apparatus is arranged in such a manner that after separating a light beam emitted from a lamp 614 such as a UHP lamp (high-pressure mercury pump) into R, G, and B using a dichroic mirror 605, the beams of R, G, and B enter the respective liquid crystal panels 601-603, and then the beams of R, G, and B are re-united by a cross prism 606 so as to be projected on a screen using a projection lens 607. To put it another way, each of the liquid crystal panels 601-603, which functions as a filter allowing a monochromatic light beam which is R, G, or B to pass through, enables to carry out tonal displaying including halftones by controlling the optical transmittance, so as to realize full-color displaying by synthesizing tones obtained in each colors of R, G, and B.

As the arrangement of the projection apparatus in FIG. 10 clearly shows, since this apparatus has more components than direct-viewing display apparatuses so as to have a more complicated arrangement, the downsizing of the components including optical components such as various lenses will be inevitably required and hence the development of a small and high-resolution liquid crystal display apparatus will provide the advantages in both performances and costs, when one tries to fabricate a projection apparatus. By the present invention, speedy operation and the decrease of the layout space which are critical factors for the small and high-resolution liquid crystal display apparatus can be realized with sufficient flexibility so that the better display quality can be obtained.

Thus, the present invention is suitably used for this kind of liquid crystal display apparatuses requiring high-resolution and high-quality displaying, and hence adopting the present invention enables to realize a projection apparatus with high-resolution and high-quality display.

As described above, the display apparatus in accordance with the present invention comprises: a plurality of pixel display sections provided in a matrix manner; a plurality of video lines for supplying video signals; a plurality of signal lines which are connected to the respective plurality of pixel display sections, so as to supply the video signals to the plurality of pixel display sections; a plurality of sampling means for sampling the video signals supplied via the plurality of video lines and supplying the video signals to the plurality of signal lines; a plurality of connecting lines for connecting the plurality of video lines to the plurality of sampling means, the plurality of connecting lines being provided so as to intersect with the plurality of video lines; and delay means for delaying the video signals which pass through the plurality of video lines, in order to compensate difference of delay of the plurality of video signals between the plurality of connecting lines, at least the plurality of pixel display sections, the plurality of video lines, the plurality of signal lines, the plurality of sampling means, and the plurality of connecting lines being integrally formed on a single substrate.

Thus, the delay means for delaying the video signals passing through the video lines is provided in order to compensate the difference of the delay between the video signals passing through the connecting lines, and hence the connecting lines receive the video signals which have been delayed in advance. In other words, the difference of the resistances between the pathways from the respective video lines to the sampling means via the connecting lines is compensated by delaying the video signals passing through the video lines.

On this account, the video signals passing through the video lines are delayed by the delay means in order to compensate the delay caused by the difference of the resistances between the connecting lines, the difference of the resistances being predominantly caused in accordance with the difference of the lengths of the connecting lines, so that it is possible to almost simultaneously input the video signals from the connecting lines to the sampling means.

Thus, since the delay of the video signals occurring on the pathways from the video lines to the sampling means is compensated, the non-uniformity of luminance looking like lines, the non-uniformity being generated due to the difference of the delay between the video signals on the occasion of being inputted to the sampling means, is eliminated so that it is possible to improve the display quality.

Moreover, with this arrangement, the difference of the delay between the video signals passing through the connecting lines, i.e. the difference of the resistances caused by the difference of the lengths of the connecting lines is compensated by adjusting the amounts of the delay of the video signals passing through the video lines, without changing the widths and the lengths of the connecting lines. For this reason, it is possible to obtain the design flexibility of the connecting lines and the sampling means.

In this manner, since it is unnecessary to arrange the connecting lines and the sampling means in an over-elaborated manner, it is possible to optimally design the pixel display sections especially in the case of display apparatuses requiring high-speed sampling, such as high-resolution display apparatuses with not more than 20 μm pixel spacing. On this account, it is possible to eliminate the non-uniformity of luminance looking like lines so as to obtain good display quality, while the high-speed sampling being realized at the same time.

There are some specific methods of adjusting the amounts of the delay of the video signals passing through the video lines, such that the video signals are supplied to a delay circuit before inputted to the video lines, etc. Here, taking account of the easiness of the adjustment of the delay and the easiness of designing, it is considered that a method in which the resistances of the video lines are adjusted in order to adjust the amounts of the delay of the video signals passing through the video lines is suitably adopted, as described below.

That is to say, the delay means may be arranged so as to cause delay of the video signals passing through the plurality of video lines, by adjusting resistances of respective parts of the plurality of video lines, the parts extending from the delay means to respective intersections of the plurality of video lines and first ones of the plurality of connecting lines.

There are specific methods of adjusting the resistances of the video lines as in the following description.

For instance, provided that a resistance of one of the plurality of connecting lines connected to an n-th (n>0) one of the plurality of video lines is Rcn, a resistance Rvn of the n-th video line is arranged so as to meet either one of two sets of inequalities:

$$Rc1>Rc2>\ldots>Rcn>Rc(n+1)>\ldots \text{ and}$$

$$Rv1<Rv2<\ldots<Rvn<Rv(n+1)<\ldots$$

and $$Rc1<Rc2<\ldots<Rcn<Rc(n+1)<\ldots \text{ and}$$

$$Rv1>Rv2>\ldots>Rvn>Rv(n+1)>\ldots$$

When the plurality of sampling means simultaneously sample the video signals passing through n (n>0) video lines of the plurality of video lines (i.e. multipoint simultaneous sampling is carried out), provided that a resistance of one of the plurality of connecting lines connected to an n-th (n>0) one of video lines is Rcn, a resistance Rvn of the n-th video line is arranged so as to meet either one of two sets of inequalities:

$$Rc1>Rc2>\ldots>Rcn \text{ and } Rv1<Rv2<\ldots<Rvn$$

and $$Rc1<Rc2<\ldots<Rcn \text{ and } Rv1>Rv2>\ldots>Rvn$$

In this arrangement, the resistances of video lines which are connected to respective connecting lines which have high resistances are lowered, so that the gap of the delay between the video signals passing through the connecting lines with high resistances and the video signals passing through the connecting lines with low resistances is reduced.

With this arrangement, it is possible to eliminate the non-uniformity of luminance looking like lines which is caused due to the difference of the delay between the video signals supplied to the sampling means, without changing the widths and the lengths of the connecting lines.

Moreover, provided that a resistance of one of the plurality of connecting lines connected to an n-th (n>0) one of the plurality of video lines is Rcn, a resistance Rvn of the n-th video line may be arranged so as to meet an equation:

$$Rv1+Rc1=Rv2+Rc2\mathbf{32}\ldots=Rvn+Rcn=Rv(n+1)+Rc(n+1)=\ldots$$

Further, when the plurality of sampling means simultaneously sample the video signals passing through n (n>0) video lines of the plurality of video lines (i.e. multipoint simultaneous sampling is carried out), provided that a resistance of one of the plurality of connecting lines connected to an n-th (n>0) one of the video lines is Rcn, a resistance Rvn of the n-th video line may be arranged so as to meet an equation:

$$Rv1+Rc1=Rv2+Rc2=\ldots=Rvn+Rcn$$

In this case, the resistances of the video lines are adjusted so as to equalize the resistances of the respective pathways from the video lines to the sampling means via the connecting lines, rather than the resistances of the video lines, which are connected to the respective connecting lines with high resistances, are simply lowered. On this account, the difference of the delay between the video signals passing through the respective pathways does not occur.

Consequently, the video signals are inputted from the connecting lines to the sampling means at identical timings, and this makes it possible to eliminate the non-uniformity of luminance looking like lines so as to obtain good display quality.

Moreover, even in the case of high-resolution display apparatuses having not more than 20 μm pixel spacing, meeting the aforementioned equation certainly prevents the delay of the video signals from being differed between the connecting lines, and this realizes high resolution and high quality display without the non-uniformity of luminance looking like lines.

The delay means may adjust time constants figured out from parasitic capacitances and resistances both regarding pathways from the plurality of video lines to the plurality of sampling means via the plurality of connecting lines, so as to delay the video signals passing through the plurality of video lines.

According to this arrangement, the time constants of the pathways from the video lines to the sampling means via the connecting lines, the time constants being figured out from the parasitic capacitances and the resistances of the respective pathways, are adjusted in order to delay the video signals passing through the video lines, so that it is possible to realize the pathways which are substantially identical to each other, as distributed constant circuits each including the parasitic capacitance and the resistance.

Thus, it is possible to eliminate the difference of the delay between the video signals passing through the connecting lines with more certainty, so as to improve the display quality.

In this instance, as in the case of taking the resistances of the pathways into account, for instance, provided that a resistance of one of the plurality of connecting lines connected to an n-th (n>0) one of the plurality of video lines is Rcn, a parasitic capacitance of the connecting line connected to the n-th video line is Ccn, a parasitic capacitance of the n-th video line is Cvn, and load capacitances regarding the plurality of sampling means are Csl, a resistance of the n-th video line Rvn is arranged so as to meet either one of two sets of inequalities:

$$Rc1\times(Cc1/2+Csl)>Rc2\times(Cc2/2+Csl)>Rc3\times(Cc3/2+Csl)\ldots>Rcn\times(Ccn/2+Csl)>Rc(n+1)\times(Cc(n+1)/2+Csl)>\ldots \text{ and}$$

$$Rv1\times(Cv1/2+Cc1+Csl)<Rv2\times(Cv2/2+Cc2+Csl)<Rv3\times(Cv3/2+Cc3+Csl)\ldots<Rvn\times(Cvn/2+Ccn+Csl)<Rv(n+1)\times(Cv(n+1)/2+Cc(n+1)+Csl)<\ldots$$

and $$Rc1\times(Cc1/2+Csl)<Rc2\times(Cc2/2+Csl)<Rc3\times(Cc3/2+Csl)\ldots<Rcn\times(Ccn/2+Csl)<Rc(n+1)\times(Cc(n+1)/2+Csl)<\ldots \text{ and}$$

$$Rv1\times(Cv1/2+Cc1+Csl)>Rv2\times(Cv2/2+Cc2+Csl)>Rv3\times(Cv3/2+Cc3+Csl)\ldots>Rvn\times(Cvn/2+Ccn+Csl)>Rv(n+1)\times(Cv(n+1)/2+Cc(n+1)+Csl)>\ldots$$

Also, when the plurality of sampling means simultaneously sample the video signals passing through n (n>0)

video lines of the plurality of video lines (i.e. multipoint simultaneous sampling is carried out), provided that a resistance of one of the plurality of connecting lines connected to an n-th (n>0) one of the plurality of video lines is Rcn, a parasitic capacitance of the connecting line connected to the n-th video line is Ccn, a parasitic capacitance of the n-th video line is Cvn, and load capacitances regarding the plurality of sampling means are Csl, a resistance of the n-th video line Rvn is arranged so as to meet either one of two sets of inequalities:

$$Rc1\times(Cc1/2+Csl)>Rc2\times(Cc2/2+Csl)>Rc3\times(Cc3/2+Csl)\ldots>Rcn\times(Ccn/2+Csl)\text{ and}$$

$$Rv1\times(Cv1/2+Cc1+Csl)<Rv2\times(Cv2/2+Cc2+Csl)<Rv3\times(Cv3/2+Cc3+Csl)\ldots<Rvn\times(Cvn/2+Ccn+Csl)$$

and $$Rc1\times(Cc1/2+Csl)<Rc2\times(Cc2/2+Csl)<Rc3\times(Cc3/2+Csl)\ldots<Rcn\times(Ccn/2+Csl)\text{ and}$$

$$Rv1\times(Cv1/2+Cc1+Csl)>Rv2\times(Cv2/2+Cc2+Csl)>Rv3\times(Cv3/2+Cc3+Csl)\ldots>Rvn\times(Cvn/2+Ccn+Csl)$$

In this arrangement, since the time constants (products of the resistances and parasitic capacitances) of the video lines which are connected to the connecting lines having high time constants are lowered, it is possible to certainly reduce the difference between the video signals passing through the connecting lines having high time constants and the video signals passing through the connecting lines having low time constants.

On this account, it is possible to eliminate the non-uniformity of luminance looking like lines which is caused due to the difference of the delay between the video signals supplied to the sampling means, without changing the widths and the lengths of the connecting lines.

Moreover, provided that a resistance of one of the plurality of connecting lines connected to an n-th (n>0) one of the plurality of video lines is Rcn, a parasitic capacitance of the connecting line connected to the n-th video line is Ccn, a parasitic capacitance of the n-th video line is Cvn, and load capacitances regarding the plurality of sampling means are Csl, a resistance of the n-th video line Rvn is arranged so as to meet an equation:

$$Rv1\times(Cv1/2+Cc1+Csl)+Rc1\times(Cc1/2+Csl)=Rv2\times(Cv2/2+Cc2+Csl)+Rc2\times(Cc2/2+Csl)=\ldots=Rvn\times(Cvn/2+Ccn+Csl)+Rcn\times(Ccn/2+Csl)=Rv(n+1)\times(Cv(n+1)/2+Cc(n+1)+Csl)+Rc(n+1)\times(Cc(n+1)/2+Csl)=\ldots$$

When the plurality of sampling means simultaneously sample the video signals passing through n (n>0) video lines of the plurality of video lines, provided that a resistance of one of the plurality of connecting lines connected to an n-th (n>0) one of the plurality of video lines is Rcn, a parasitic capacitance of the connecting line connected to the n-th video line is Ccn, a parasitic capacitance of the n-th video line is Cvn, and load capacitances regarding the plurality of sampling means are Csl, a resistance of the n-th video line Rvn is arranged so as to meet an equation:

$$Rv1\times(Cv1/2+Cc1+Csl)+Rc1\times(Cc1/2+Csl)=Rv2\times(Cv2/2+Cc2+Csl)+Rc2\times(Cc2/2+Csl)=\ldots=Rvn\times(Cvn/2+Ccn+Csl)+Rcn\times(Ccn/2+Csl)$$

According to this arrangement, the resistances of the video lines are adjusted so as to equalize the resistances of the respective pathways from the video lines to the sampling means via the connecting lines, rather than the resistances of the video lines, which are connected to the respective connecting lines with high resistances, are simply lowered. On this account, the difference of the delay between the video signals passing through the respective pathways does not occur so that it is possible to realize the pathways which are substantially identical to each other, as distributed constant circuits each including the parasitic capacitance and the resistance.

Thus, it is possible to eliminate the difference of the delay the video signals between the connecting lines with more certainty, so as to improve the display quality.

Moreover, even in the case of high-resolution display apparatuses having not more than 20 μm pixel spacing, meeting the aforementioned equation certainly prevents the delay of the video signals from being differed between the connecting lines, and this realizes high resolution and high quality display without the non-uniformity of luminance looking like lines.

The resistances of the plurality of video lines are adjusted by changing lengths and widths of the plurality of video lines.

According to this arrangement, it is possible to adjust the resistances of the video lines with a simple arrangement.

The resistances of the plurality of video lines are adjusted by electrically connecting resistive elements, which are made of a material different from a material of the plurality of video lines, to the plurality of video lines.

In this case, since the resistive elements are provided in addition to the video lines, it is possible to adjust the amounts of the delay of the video signals passing through the video lines even if, for instance, the widths and the lengths of the video lines are under constraints.

As described above, the driving method of the display apparatus in accordance with the present invention, including: a plurality of pixel display sections; a plurality of video lines for supplying video signals; a plurality of signal lines which are connected to the respective plurality of pixel display sections, so as to supply the video signals to the plurality of pixel display sections; a plurality of sampling means for sampling the video signals supplied via the plurality of video lines and supplying the video signals to the plurality of signal lines; and a plurality of connecting lines for connecting the plurality of video lines to the plurality of sampling means, the plurality of connecting lines being provided so as to intersect with the plurality of video lines, the plurality of pixel display sections, the plurality of video lines, the plurality of pixel display sections, the plurality of video lines, the plurality of signal lines, the plurality of sampling means, and the plurality of connecting lines being integrally formed on a single substrate, the method of driving the display apparatus comprises the step of delaying the video signals and then inputting the video signals from the plurality of video lines to the plurality of connecting lines, in order to compensate difference of delay of the video signals, the difference of delay occurring between the plurality of connecting lines.

In this arrangement, it is unnecessary to provide the delay means, which is for delaying the video signals passing through the video lines, inside the drive circuits of the display apparatus. To put it another way, the delay means may be provided inside the drive circuits of the display apparatus, or the delay means may be provided outside of the same.

On this account, with a simpler arrangement, it is possible to realize a display apparatus in which the difference of the delay between the video signals passing through the connecting lines is compensated so that the display quality can be improved.

As described above, the projection apparatus in accordance with the present invention, which includes a display apparatus and projects a display screen image of the display apparatus in a magnified form, adopts the display apparatus of the present invention as the display apparatus.

With this arrangement, it is possible to realize a projection apparatus with high-resolution and high-quality display.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display apparatus, comprising:

a plurality of pixel display sections provided in a matrix manner;

a plurality of video lines for supplying video signals;

a plurality of signal lines which are connected to the respective plurality of pixel display sections, so as to supply the video signals to the plurality of pixel display sections;

a plurality of sampling means for sampling the video signals supplied via the plurality of video lines and supplying the video signals to the plurality of signal lines;

a plurality of connecting lines for connecting the plurality of video lines to the plurality of sampling means, the plurality of connecting lines being provided so as to intersect with the plurality of video lines; and delay means for delaying the video signals which pass through the plurality of video lines , in order to compensate for a difference in delay of the plurality of video signals between the plurality of connecting lines, at least the plurality of pixel display sections, the plurality of video lines, the plurality of signal lines, the plurality of sampling means, and the plurality of connecting lines being integrally formed on a single substrate; and wherein the delay means causes delay of the video signals passing through the plurality of video lines, by adjusting resistances of respective parts of the plurality of video lines, the parts extending from the delay means to respective intersections of the plurality of video lines and first ones of the plurality of connecting lines.

2. The display apparatus as defined in claim 1, wherein, provided that a resistance of one of the plurality of connecting lines connected to an n-th (n>0) one of the plurality of video lines is Rcn, a resistance Rvn of the n-th video line is arranged so as to meet either one of two sets of inequalities:

$$Rc1>Rc2>\ldots>Rcn>Rc(n+1)>\ldots \text{ and}$$

$$Rv1<Rv2<\ldots<Rvn<Rv(n+1)<\ldots$$

and $$Rc1<Rc2<\ldots<Rcn<Rc(n+1)<\ldots \text{ and}$$

$$Rv1>Rv2>\ldots>Rvn>Rv(n+1)>\ldots$$

3. The display apparatus as defined in claim 1, wherein, when the plurality of sampling means simultaneously sample the video signals passing through n (n>0) video lines of the plurality of video lines, provided that a resistance of one of the plurality of connecting lines connected to an n-th (n>0) one of video lines is Rcn, a resistance Rvn of the n-th video line is arranged so as to meet either one of two sets of inequalities:

$$Rc1>Rc2>\ldots>Rcn \text{ and } Rv1<Rv2<\ldots<Rvn$$

and $$Rc1<Rc2<\ldots<Rcn \text{ and } Rv1>Rv2>\ldots>Rvn.$$

4. The display apparatus as defined in claim 1, wherein, provided that a resistance of one of the plurality of connecting lines connected to an n-th (n>0) one of the plurality of video lines is Rcn, a resistance Rvn of the n-th video line is arranged so as to meet an equation:

$$Rv1+Rc1=Rv2+Rc2=\ldots=Rvn+Rcn=Rv(n+1)+Rc(n+1)=\ldots$$

5. The display apparatus as defined in claim 1, wherein, when the plurality of sampling means simultaneously sample the video signals passing through n (n>0) video lines of the plurality of video lines, provided that a resistance of one of the plurality of connecting lines connected to an n-th (n>0) one of the video lines is Rcn, a resistance Rvn of the n-th video line is arranged so as to meet an equation:

$$Rv1+Rc1=Rv2+Rc2=\ldots=Rvn+Rcn.$$

6. The display apparatus as defined in claim 1, wherein the resistances of the plurality of video lines are adjusted by changing lengths or widths of the plurality of video lines.

7. The display apparatus as defined in claim 1, wherein, the resistances of the plurality of video lines are adjusted by electrically connecting resistive elements, which are made of a material different from a material of the plurality of video lines, to the plurality of video lines.

8. The display apparatus as defined in claim 1, wherein, the delay means adjusts time constants figured out from parasitic capacitances and resistances both regarding pathways from the plurality of video lines to the plurality of sampling means via the plurality of connecting lines, so as to delay the video signals passing through the plurality of video lines.

9. The display apparatus as defined in claim 8, wherein, provided that a resistance of one of the plurality of connecting lines connected to an n-th (n>0) one of the plurality of video lines is Rcn, a parasitic capacitance of the connecting line connected to the n-th video line is Ccn, a parasitic capacitance of the n-th video line is Cvn, and load capacitances regarding the plurality of sampling means are Csl, a resistance of the n-th video line Rvn is arranged so as to meet either one of two sets of inequalities:

$$Rc1\times(Cc1/2+Csl)>Rc2\times(Cc2/2+Csl)>Rc3\times(Cc3/2+Csl)\ldots>Rcn\times(Ccn/2+Csl)>Rc(n+1)\times(Cc(n+1)/2+Csl)>\ldots \text{ and}$$

$$Rv1\times(Cv1/2+Cc1+Csl)<Rv2\times(Cv2/2+Cc2+Csl)<Rv3\times(Cv3/2+Cc3+Csl)\ldots<Rvn\times(Cvn/2+Ccn+Csl)<Rv(n+1)\times(Cv(n+1)/2+Cc(n+1)+Csl)<\ldots$$

and $$Rc1\times(Cc1/2+Csl)<Rc2\times(Cc2/2+Csl)<Rc3'(Cc3/2+Csl)\ldots<Rcn\times(Ccn/2+Csl)<Rc(n+1)\times(Cc(n+1)/2+Csl)<\ldots \text{ and}$$

$$Rv1\times(Cv1/2+Cc1+Csl)>Rv2\times(Cv2/2+Cc2+Csl)>Rv3\times(Cv3/2+Cc3+Csl)\ldots>Rvn\times(Cvn/2+Ccn+Csl)>Rv(n+1)\times(Cv(n+1)/2+Cc(n+1)+Csl)>\ldots$$

10. The display apparatus as defined in claim 8, wherein, when the plurality of sampling means simultaneously sample the video signals passing through n (n>0) video lines of the plurality of video lines, provided that a resistance of one of the plurality of connecting lines connected to an n-th (n>0) one of the plurality of video lines is Rcn, a parasitic capacitance of the connecting line connected to the n-th video line is Ccn, a parasitic capacitance of the n-th video line is Cvn, and load capacitances regarding the plurality of sampling means are Csl, a resistance of the n-th video line Rvn is arranged so as to meet either one of two sets of inequalities:

$$Rc1\times(Cc1/2+Csl)>Rc2\times(Cc2/2+Csl)>Rc3\times(Cc3/2+Csl)\ldots>Rcn\times(Ccn/2+Csl)\text{ and}$$

$$Rv1\times(Cv1/2+Cc1+Csl)<Rv2\times(Cv2/2+Cc2+Csl)<Rv3\times(Cv3/2+Cc3+Csl)\ldots<Rvn\times(Cvn/2+Ccn+Csl)$$

and $$Rc1\times(Cc1/2+Csl)<Rc2\times(Cc2/2+Csl)<Rc3\times(Cc3/2+Csl)\ldots<Rcn\times(Ccn/2+Csl)\text{ and}$$

$$Rv1\times(Cv1/2+Cc1+Csl)>Rv2\times(Cv2/2+Cc2+Csl)>Rv3\times(Cv3/2+Cc3+Csl)\ldots>Rvn\times(Cvn/2+Ccn+Csl).$$

11. The display apparatus as defined in claim 8, wherein, provided that a resistance of one of the plurality of connecting lines connected to an n-th (n>0) one of the plurality of video lines is Rcn, a parasitic capacitance of the connecting line connected to the n-th video line is Ccn, a parasitic capacitance of the n-th video line is Cvn, and load capacitances regarding the plurality of sampling means are Csl, a resistance of the n-th video line Rvn is arranged so as to meet an equation:

$$Rv1\times(Cv1/2+Cc1+Csl)+Rc1\times(Cc1/2+Csl)=Rv2\times(Cv2/2+Cc2+Csl)+Rc2\times(Cc2/2+Csl)=\ldots=Rvn\times(Cvn/2+Ccn+Csl)+Rcn\times(Ccn/2+Csl)=Rv(n+1)\times(Cv(n+1)/2+Cc(n+1)+Csl)+Rc(n+1)\times(Cc(n+1)/2+Csl)=\ldots$$

12. The display apparatus as defined in claim 8, wherein, when the plurality of sampling means simultaneously sample the video signals passing through n (n>0) video lines of the plurality of video lines, provided that a resistance of one of the plurality of connecting lines connected to an n-th (n>0) one of the plurality of video lines is Rcn, a parasitic capacitance of the connecting line connected to the n-th video line is Ccn, a parasitic capacitance of the n-th video line is Cvn, and load capacitances regarding the plurality of sampling means are Csl, a resistance of the n-th video line Rvn is arranged so as to meet an equation:

$$Rv1\times(Cv1/2+Cc1+Csl)+Rc1\times(Cc1/2+Csl)=Rv2\times(Cv2/2+Cc2+Csl)+Rc2\times(Cc2/2+Csl)=\ldots=Rvn\times(Cvn/2+Ccn+Csl)+Rcn\times(Ccn/2+Csl).$$

13. The display apparatus as defined in claim 8, wherein the resistances of the plurality of video lines are adjusted by changing lengths and widths of the plurality of video lines.

14. The display apparatus as defined in claim 8, wherein, the resistances of the plurality of video lines are adjusted by electrically connecting resistive elements, which are made of a material different from a material of the plurality of video lines, to the plurality of video lines.

15. The display apparatus as defined in claim 1, wherein the delay means delays the video signals before the video signals are output from the video lines.

16. The display apparatus as defined in claim 1, wherein the video signals represent an image to be displayed by the plurality of pixel display sections.

17. The display apparatus as defined in claim 1, wherein a set of connecting lines is connected to one of the sampling means with each of the connecting lines of the set involving a different delay for the video signals transmitted thereby, and wherein the delay means delays the video signals which pass through the plurality of video lines in order to compensate for different delays of the plurality of the video signals transmitted by the plurality of the connecting lines of the set.

18. A method of driving a display apparatus including:

a plurality of pixel display sections;

a plurality of video lines for supplying video signals;

a plurality of signal lines which are connected to the respective plurality of pixel display sections, so as to supply the video signals to the plurality of pixel display sections;

a plurality of sampling means for sampling the video signals supplied via the plurality of video lines and supplying the video signals to the plurality of signal lines; and a plurality of connecting lines for connecting the plurality of video lines to the plurality of sampling means, the plurality of connecting lines being provided so as to intersect with the plurality of video lines, the plurality of pixel display sections, the plurality of video lines, the plurality of pixel display sections, the plurality of video lines, the plurality of signal lines, the plurality of sampling means, and the plurality of connecting lines being integrally formed on a single substrate, the method of driving the display apparatus comprising the step of:

delaying the video signals passing through the plurality of video lines and then inputting the video signals from the plurality of video lines to the plurality of connecting lines, in order to compensate for a difference in delay of the video signals, the difference of delay occurring between the plurality of connecting lines; and wherein delaying of the video signals comprises adjusting resistances of respective parts of the plurality of video lines, the parts extending from the delay means to respective intersections of the plurality of video lines and first ones of the plurality of connecting lines.

19. The method as defined in claim 18, wherein the video signals represent an image to be displayed by the plurality of pixel display sections.

20. The method as defined in claim 18, wherein a set of connecting lines is connected to one of the sampling means with each of the connecting lines of the set involving a different delay for the video signals transmitted thereby, and further comprising delaying the video signals which pass through the plurality of video lines in order to compensate for different delays of the plurality of the video signals transmitted by the plurality of the connecting lines of the set.

21. A projection apparatus comprising a display apparatus, the projection apparatus projecting a display screen image of the display apparatus in a magnified form, wherein, the display apparatus includes:

a plurality of pixel display sections provided in a matrix manner;

a plurality of video lines for supplying video signals;

a plurality of signal lines which are connected to the respective plurality of pixel display sections, so as to supply the video signals to the plurality of pixel display sections;

a plurality of sampling means for sampling the video signals supplied via the plurality of video lines and supplying the video signals to the plurality of signal lines;

a plurality of connecting lines for connecting the plurality of video lines to the plurality of sampling means, the plurality of connecting lines being provided so as to intersect with the plurality of video lines; and delay means for delaying the video signals which pass through the plurality of video lines , in order to compensate for a difference in delay of the plurality of video signals between the plurality of connecting lines, at least the plurality of pixel display sections, the plurality of video lines, the plurality of signal lines, the plurality of sampling means, and the plurality of connecting lines being integrally formed on a single substrate; and wherein the delay means causes delay of the video signals passing through the plurality of video lines, by adjusting resistances of respective parts of the plurality of video lines, the parts extending from the delay means to respective intersections of the plurality of video lines and first ones of the plurality of connecting lines.

22. The display apparatus as defined in claim 21, wherein a set of connecting lines is connected to one of the sampling means with each of the connecting lines of the set involving a different delay for the video signals transmitted thereby, and wherein the delay means delays the video signals which pass through the plurality of video lines in order to compensate for different delays of the plurality of the video signals transmitted by the plurality of the connecting lines of the set.

23. A display apparatus comprising:

plural pixel display sections;

plural video lines for supplying video signals;

plural signal lines which are connected to the respective plural pixel display sections for supplying the video signals to the plural pixel display sections plural connecting lines for connecting the plural video lines to selected ones of the plural signal lines;

a delay circuit configured to differently delay the video signals as the video signals pass through the respective plural video lines in order to compensate for a difference in delay of occasioned by the plurality of connecting lines; and wherein the delay circuit is configured to delay the video signals passing through the plurality of video lines by adjusting resistances of respective parts of the plurality of video lines, the parts extending from the delay circuit to respective intersections of the plurality of video lines and first ones of the plural of connecting lines.

24. The display apparatus of claim 23, wherein the display circuit comprises the video lines having a different parameter, and preferably comprises the video lines having a different width or length.

25. The display apparatus of claim 23, wherein the display circuit comprises the video lines each comprising a compensating resistor, and wherein differing video lines have differing resistances for the compensating resistor.

26. The display apparatus as defined in claim 23, wherein the connecting lines are grouped in sampling sets with each of the connecting lines of a set involving a different delay for the video signals transmitted thereby, and wherein the delay circuit delays the video signals as the video signals pass through the respective plural video lines in order to compensate for different delays of occasioned by the plurality of connecting lines of the set.

* * * * *